US006994225B2

(12) United States Patent
Hakim

(10) Patent No.: US 6,994,225 B2
(45) Date of Patent: Feb. 7, 2006

(54) NO-SPILL DRINKING PRODUCTS

(76) Inventor: Nouri E. Hakim, 3030 Aurora Ave., Monroe, LA (US) 71201

( * ) Notice: Subject to any disclaimer, the term of this patent is extended or adjusted under 35 U.S.C. 154(b) by 0 days.

(21) Appl. No.: 10/634,732

(22) Filed: Aug. 5, 2003

(65) Prior Publication Data

US 2004/0164043 A1 Aug. 26, 2004

Related U.S. Application Data

(60) Provisional application No. 60/400,669, filed on Aug. 5, 2002.

(51) Int. Cl.
*A61J 9/00* (2006.01)
*A61J 9/04* (2006.01)
*A61J 11/00* (2006.01)

(52) U.S. Cl. ..... 215/11.4; 215/11.1; 215/11.5; 220/714

(58) Field of Classification Search ..... 215/11.1, 215/11.3, 11.4, 11.5; 220/714
See application file for complete search history.

(56) References Cited

U.S. PATENT DOCUMENTS

| | | | | | |
|---|---|---|---|---|---|
| 2,174,361 | A | * | 9/1939 | Condon | 215/11.5 |
| 2,223,179 | A | * | 11/1940 | Lougheed | 215/11.1 |
| 3,718,140 | A | * | 2/1973 | Yamauchi | 215/11.1 |
| 4,600,111 | A | * | 7/1986 | Brown | 215/6 |
| 4,623,069 | A | * | 11/1986 | White | 215/11.1 |
| 4,946,062 | A | * | 8/1990 | Coy | 220/714 |
| 4,993,568 | A | | 2/1991 | Morifuji et al. | |
| 5,101,991 | A | * | 4/1992 | Morifuji et al. | 215/11.1 |
| 5,101,992 | A | | 4/1992 | Serre | |
| D339,197 | S | | 9/1993 | Ziegler | |
| 5,244,105 | A | | 9/1993 | Serre | |
| RE34,725 | E | | 9/1994 | Braden | |
| 5,363,983 | A | * | 11/1994 | Proshan | 220/717 |
| 5,439,143 | A | * | 8/1995 | Brown et al. | 222/185.1 |
| 5,542,670 | A | | 8/1996 | Morano | |
| 5,769,285 | A | | 6/1998 | Upham et al. | |
| 5,784,999 | A | * | 7/1998 | Larson et al. | 119/71 |
| 5,788,097 | A | * | 8/1998 | McInnes | 215/11.1 |
| 5,791,510 | A | * | 8/1998 | Paczonay | 220/714 |
| 5,797,505 | A | * | 8/1998 | Kaura | 215/11.5 |
| 5,890,621 | A | * | 4/1999 | Bachman et al. | 220/717 |
| 6,112,919 | A | | 9/2000 | Ho | |
| 6,161,710 | A | | 12/2000 | Dieringer et al. | |
| 6,230,923 | B1 | * | 5/2001 | Hung | 220/703 |
| 6,321,931 | B1 | | 11/2001 | Hakim et al. | |
| 6,343,704 | B1 | * | 2/2002 | Prentiss | 215/11.1 |
| 6,357,620 | B1 | | 3/2002 | Hakim | |
| 2002/0011583 | A1 | * | 1/2002 | Getzewich et al. | |
| 2002/0063103 | A1 | | 5/2002 | Kiernan | |

FOREIGN PATENT DOCUMENTS

| | | |
|---|---|---|
| GB | 2 169 210 A | 7/1986 |
| GB | 2 215 318 A | 9/1989 |
| GB | 2 279 130 A | 12/1994 |

* cited by examiner

*Primary Examiner*—Sue A. Weaver
(74) *Attorney, Agent, or Firm*—Morris E. Cohen

(57) ABSTRACT

Improved no-spill drinking products including a nipple or soft spout having a valve incorporated therein. The valve is designed to provide an enhanced no-spill function providing an extremely secure seal against accidental liquid flow from the nipple or spout when the user is not drinking therefrom.

46 Claims, 16 Drawing Sheets

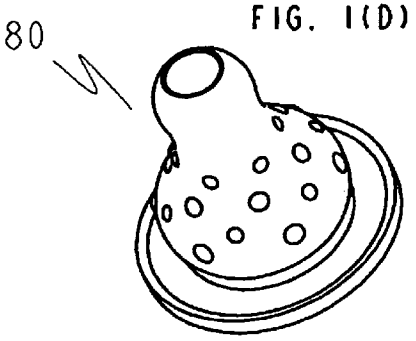
FIG. 1(D)
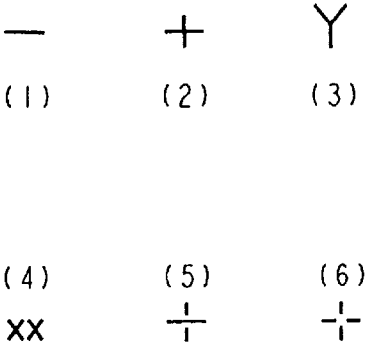
FIG. 1(E)
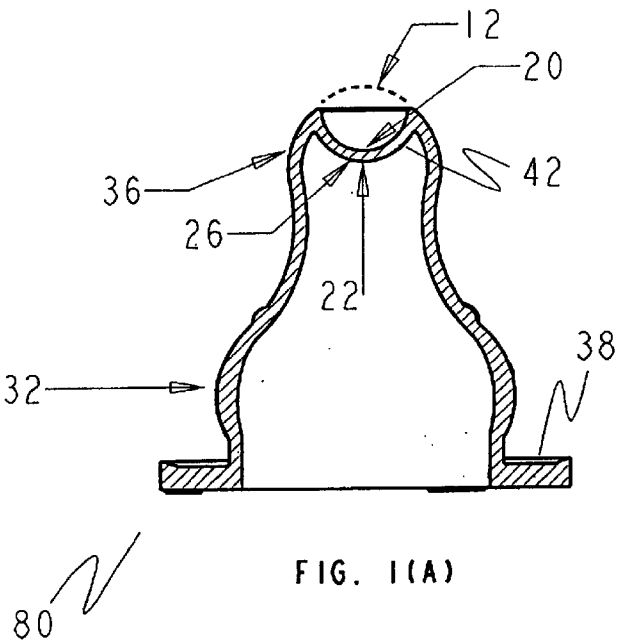
FIG. 1(A)
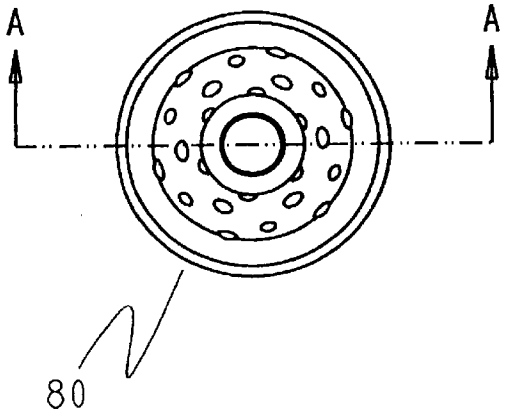
FIG. 1(B)
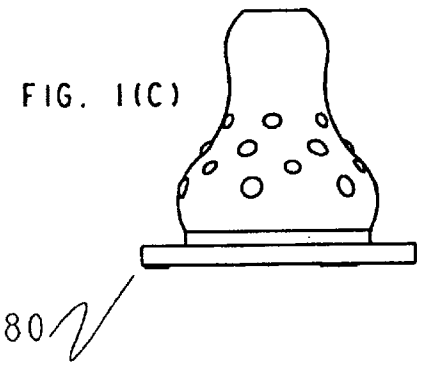
FIG. 1(C)
FIGURE 1

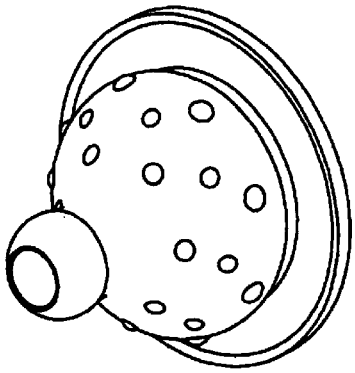
FIG. 2(D)
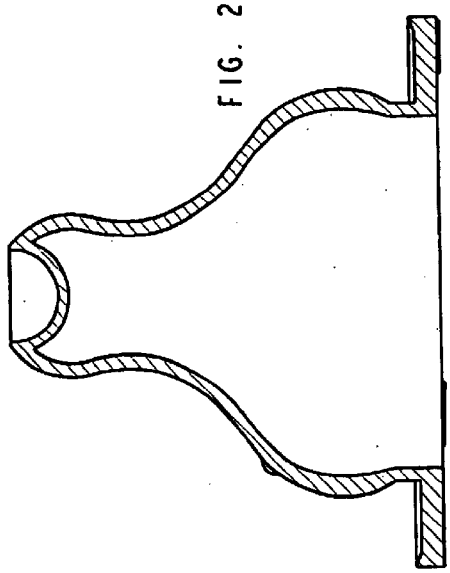
FIG. 2(A)
SECTION A-A
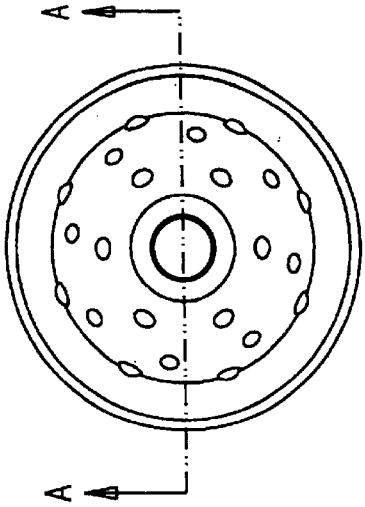
FIG. 2(B)
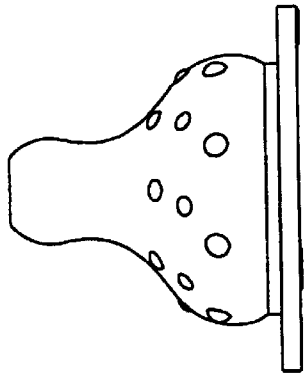
FIG. 2(C)
FIGURE 2

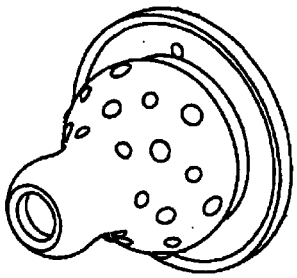
FIG. 3(D)
DETAIL SLITS
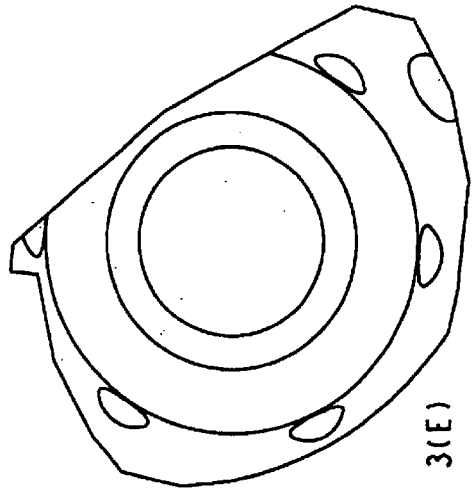
FIG. 3(E)
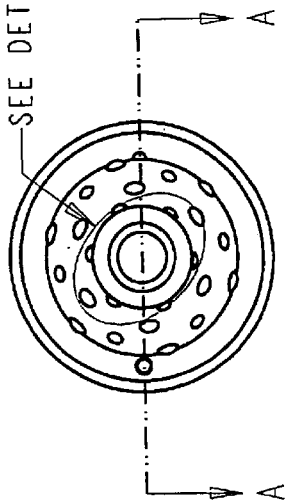
FIG. 3(B)
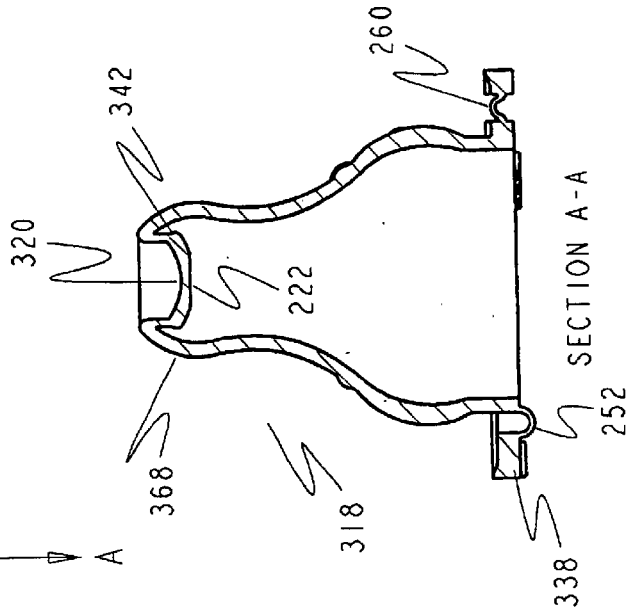
SECTION A-A
FIG. 3(A)
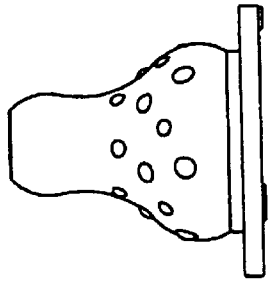
FIG. 3(C)
FIGURE 3

144
68
70
72
76
SEE DETAIL VENT
SECTION A-A 280
290
.0960
.0050
.0934
.0250
252
DETAIL VENT

DETAIL VENT
.1100
.0200
.0957
.0295
.0310
R.0780
.1958
.0980
.0200
.1660

SEE DETAIL FLOW VALVE (FIG.6(E))
SECTION AA-AA

SEE DETAIL VENT (FIG.6(F))

.0300
.0592
.0280
DETAIL FLOW VALVE
R.2244
R.0400
.0500
R.3700
.2800
.1813
STANDARD NO SPILL NIPPLE

AA

AA 1.4913
1.5000

200
138
200
200

NOTE: CUT 50% OF DIMPLE HEIGHT
HALF OF DIMPLE SHOULD BE CUT

.13
.13
CROSS CUT FOR
FLUID FLOW

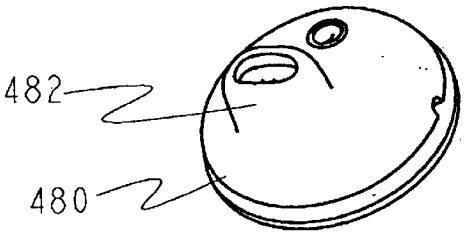
FIG. (8B)
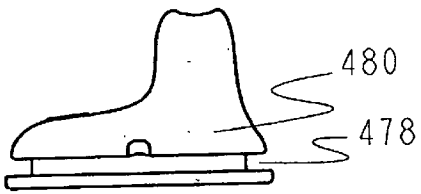
FIG. (8D)
FIGURE 8
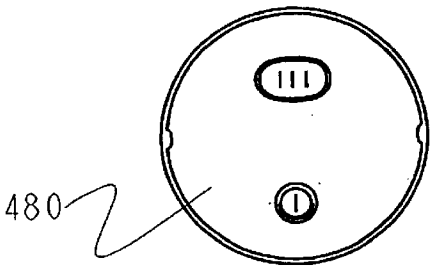
FIG. (8A)
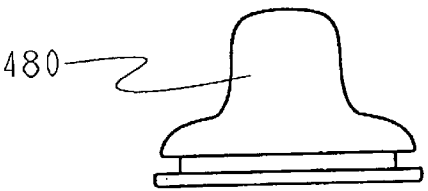
FIG. (8C)
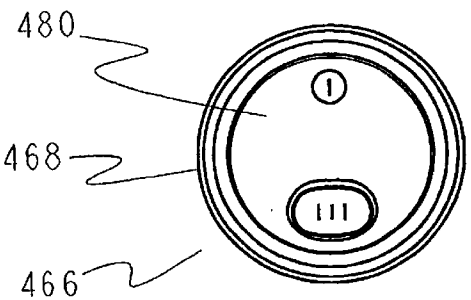
FIG. (8E)

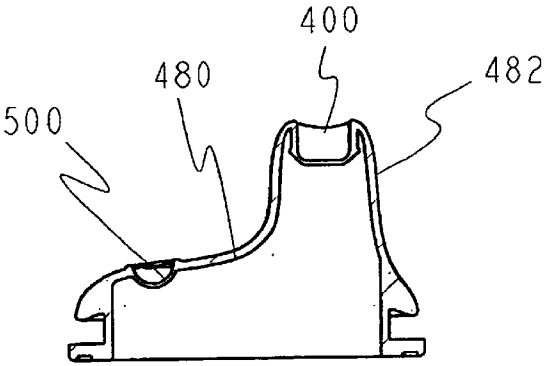
SECTION A-A
FIG. 9(A)
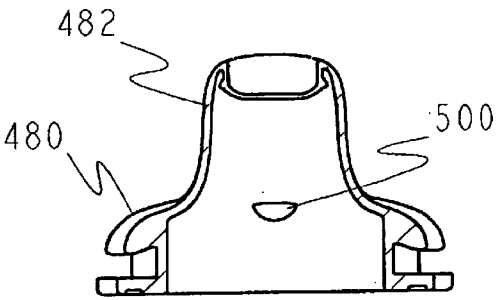
SECTION B-B
FIG. 9(B)
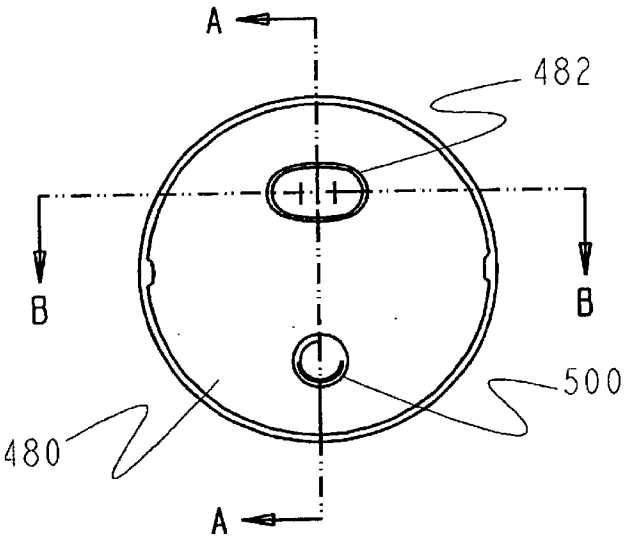
FIG. 9(C)
FIGURE 9

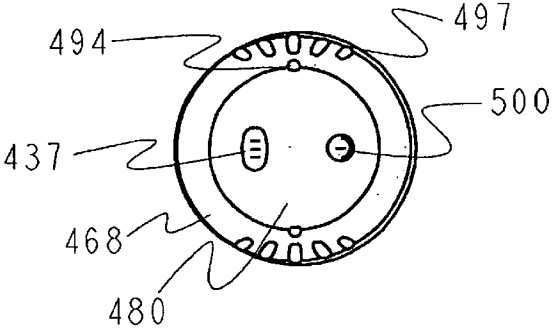
FIG. 10(A)
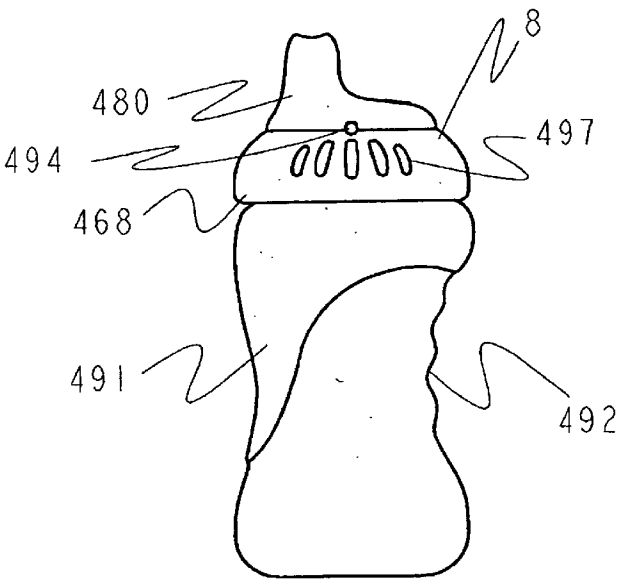
FIG. 10(B)
FIGURE 10
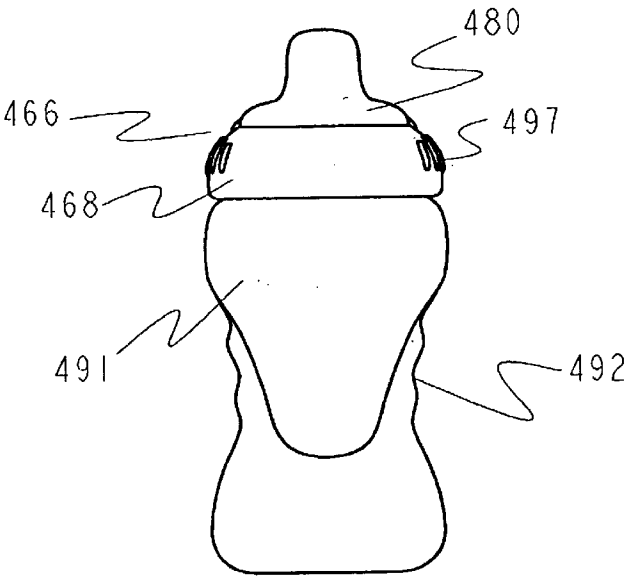
FIG. 10(C)

.02 REF
.0895
R.14 REF
DETAIL E

.052 REF
.040 REF
.028 REF
DETAIL D

SEE DETAIL E
30 REF
492
SEE DETAIL D
192 REF
SECTION A-A

A
A
480
468

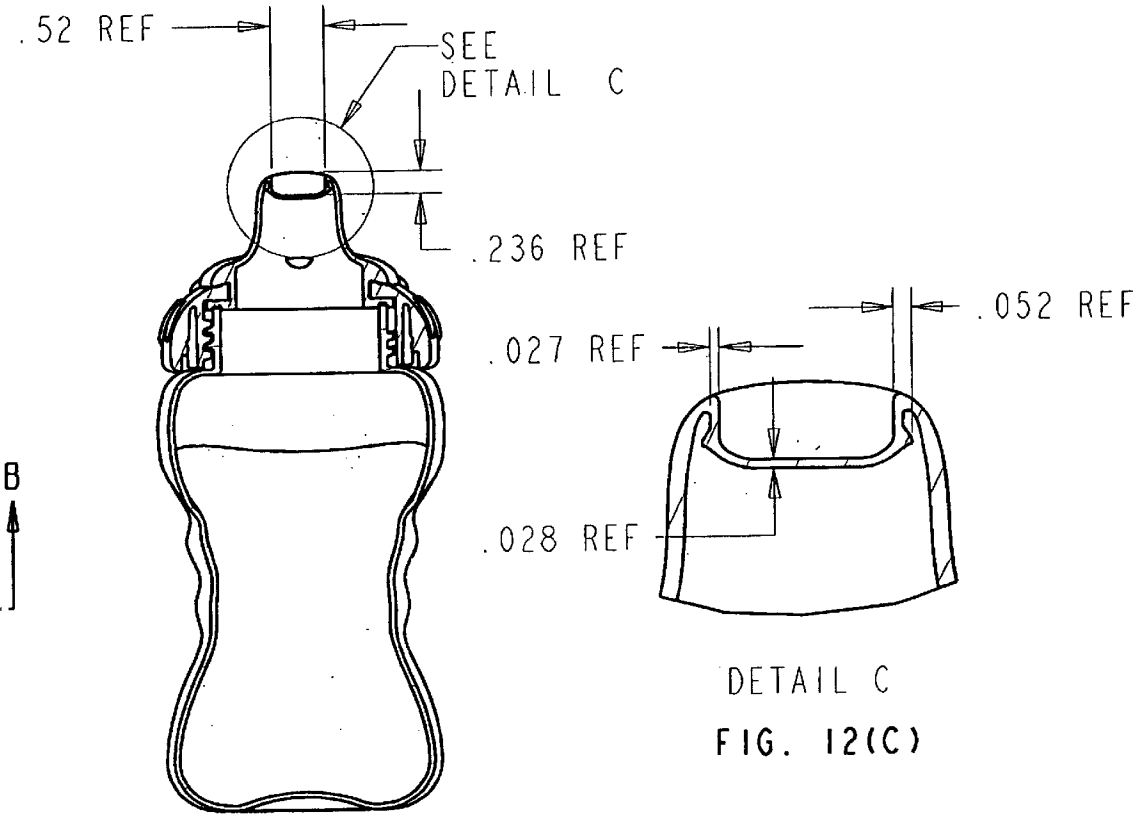
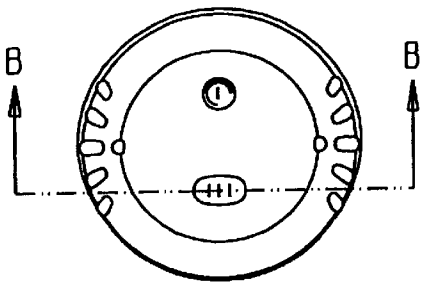
FIG. 12(A)
FIGURE 12

NO-SPILL DRINKING PRODUCTS

RELATED APPLICATIONS

The present application is a national stage application filed under 35 U.S.C. §371 of PCT/US2003/24400 filed Aug. 5, 2003 (pending), which claims the priority of U.S. Provisional Application Ser. No. 60/400,669 filed Aug. 5, 2002, both of which are fully incorporated herein by reference.

FIELD OF THE INVENTION

The present invention relates to no-spill drinking products.

BACKGROUND OF THE INVENTION

No-spill drinking products are well known in the art. In the past, a variety of such products have been developed and marketed. In general, the goal of a no-spill cup is to provide a construction which minimizes or prevents liquid from emerging out of the cup when liquid flow is not desired, i.e. when the user is not drinking. However, though the assemblies of the prior art are intended to avoid such accidents, their construction is such that they generally do not provide a secure enough protection against undesirable spilling or leakage. Thus, when such cups are inverted, or more significantly, when they are shaken vigorously, liquid will often emerge from them. This can be a particular problem with young children, for whom these cups are usually intended.

To address this problem, the present inventor has previously provided various advances in the art, as disclosed for example in U.S. Pat. Nos. 6,321,931 and 6,357,620, both of which are fully incorporated herein by reference. Further thereto, yet further improvements in the art of such no-spill drinking products are provided herein.

Moreover, while such drinking products have been generally sold as products for older children, leakage is currently also major problem with present baby bottles and bottle nipples. Most nipples have a hole in the top that fluid is drawn out of. If the bottle is not in an upright position, however, the bottle will leak. For example, if a mother mixes the contents of a baby bottle and then places that baby bottle into her diaper bag, the bottle will leak if the bottle falls over on its side or if the diaper bag is not standing straight up. The liquid from the bottle will then spill into the bag or into the bottle's cap.

Similarly, if a baby takes the bottle out of his or her mouth and lays it down, or if the bottle falls out of the baby's mouth, liquid will leak out of the nipple onto the surrounding floor, carpet, car seat, or so forth. Various different kinds of nipples are known in the art, the nipples varying depending on the type of liquid that the nipple is intended to be used with. Thus, nipples exist for use with water, milk, juice, and formula. Yet, leakage is a very significant problem with all of the various nipples currently available commercially.

If the baby falls asleep with a bottle, the milk can leak out of the bottle. This liquid could undesirably leak onto the baby and/or surrounding area. Furthermore, if the bottle were in the baby's mouth when he or she fell asleep, any liquid that leaked out could potentially choke the baby.

Accordingly, it would be a significant improvement in the art to provide a design allowing the construction of nipples and baby bottles which would eliminate leakage. It would be a further improvement to provide nipples which adjust to the various consistencies of the different liquids provided to children.

SUMMARY OF THE INVENTION

It is an object of the present invention to provide a drinking products which prevent liquid from flowing out of the cup when the user is not drinking.

It is a further object of the invention to provide an improved construction for no-spill drinking products.

It is a further object of the invention to provide a drinking products which minimize and/or eliminate accidental or undesirable liquid flow or spillage.

It is a further object of the invention to provide a drinking products which prevent liquid flow from a spout or nipple even upon very vigorous shaking of the drinking product.

It is a further object of the invention to provide a cup product which provides the ability to regulate the flow rate of liquid out of the cup.

It is a further object of the invention to provide a product which can be used by young children, to avoid accidental spilling of liquid therefrom.

It is a further object of the present invention to provide no-spill baby bottles and bottle nipples.

It is a further object of the invention to provide baby bottles and nipples that do not spill when placed on their side or inverted.

It is a further object of the invention to provide baby bottles and nipples that do not spill liquid therefrom even when shaken vigorously.

It is a further object of the invention to provide drinking products which minimize and/or eliminate accidental or undesirable liquid flow or spillage, while obtaining an easier flow of liquid with less draw or vacuum.

Further objects of the invention will become apparent in conjunction with the disclosure herein.

To accomplish the above objectives, no-spill products are provided for feeding infants, young children, and any other user, as shown in the attached figures. In several embodiments, these no-spill products include baby bottle nipples and their associated baby bottles. In further embodiments, these products include no-spill drinking cups, sports bottles, and any other desired drinking vessel.

In accordance with a first series of embodiments of the invention, improved drinking products are described which provide an extremely secure seal against accidental liquid flow from a cup spout. Further to the invention, a user places his or her mouth against the spout of the product to bite down on the soft material of the spout and to drink liquid out when desired. The spout includes a valve therein, such that the act of biting on the soft spout and/or compression of the soft spout with the tongue causes the valve to open. Upon opening, a user can suck liquid out of the spout (i.e. apply negative pressure), to drink comfortably therefrom. In contrast, when not in use, the valve sits in a resting, closed position. In this resting or relaxed state, with no compression applied, the valve sits in a configuration in which fluid is securely blocked from passage out of the drinking product. Thus, when the membrane is placed into the user's mouth, the opening within a depression in the nipple or spout tip is forced open, to allow drinking therefrom. At other times (when a user is not drinking), the configuration of the depression forces the opening closed, sealing the membrane into a no-spill position.

In the preferred embodiments of the invention, the valve consists of an depression (also referred to herein as an indentation or dimple) in a flexible material, the depression having an opening therein. The depression is especially configured to maximize its effectiveness as a no-spill valve to prevent undesired liquid flow therefrom.

In several embodiments of the invention, these membranes form the nipple of a baby bottle. In other embodiments, these membranes can be provided as part of another drinking vessel, whether for children or for adults, such as a trainer cup, a sports bottle or so forth. In such drinking vessels, the membranes can be provided as part of a spout or other component of the drinking vessel. In each of these products, the unique construction prevents leakage of fluid when the product is not upright, or when shaken.

With respect to the opening of the membrane (whether of the baby bottle nipple or soft lid portion of a drinking vessel), any form of desired opening suitable for passage of a desired level of liquid can be utilized in the valve. The opening can be, for example, a hole, a slit, a slot, an orifice, or so forth. Preferred embodiments for use in conjunction with various embodiments are disclosed below. The opening is preferably located in the surface of the membrane within the area of the depression.

In the preferred embodiments of the invention, the drinking product further includes a dual valve configuration (i.e. at least two valves), wherein the second valve is likewise provided with an opening. Upon application of negative pressure at the top of the valve (i.e. when sucking at the spout), this second valve opens to allow air into the drinking product. In so doing, the second opening acts as an air vent, preventing the formation of a vacuum within that drinking product, which would prevent liquid from flowing out of the product. The opening of this second valve thereby facilitates fluid flow from the spout when negative pressure is applied at the spout. In contrast, when the user is not applying negative pressure at the spout (i.e. when the user is not drinking), this second opening seals. If the user shakes the drinking product to provide positive pressure against the first valve, liquid is nonetheless prevented from emerging from the product. Moreover, the shaking of the vessel (or the turning of the vessel upside down or on its side), forces liquid against the second valve, thereby sealing it against air flow. This sealing of the valve against air flow, yet further prevents liquid from flowing through the opening.

Thus, in each of the embodiments of the invention, the closed valve position provides an extremely secure seal against fluid leakage, such that inadvertent spills or even deliberate attempts to force liquid outside of the cup, such as by turning the cup upside down, or shaking the cup, are ineffective. At the same time, the invention is designed to make it very easy for babies, children, or adults to comfortably extract the desired amount of liquid.

As a result, the invention provides very secure protection against fluid leakage in drinking products that can be used by individuals of all ages, while still providing a comfortable drinking product. The invention can be used by babies, children of all ages, and adults, and prevents messes whether from an accidentally knocked over product, or other spillage. It also protects users, and babies in particular, from swallowing or accidentally choking on liquid leaking into their mouth from a drinking product while they are sleeping.

In further preferred embodiments of the invention, one (or preferably both) of the valves are located in a soft portion of a hard/soft cap. This cap preferably includes a hard component, such as a ring, and a second component which attaches thereto which is soft. The hard component is provided for attachment onto the drinking vessel, and the soft portion serves as the upper portion of the lid, including a soft spout therein.

Further objects, features and advantages of the invention will become apparent in conjunction with the detailed disclosure provided herein.

BRIEF DESCRIPTION OF THE DRAWINGS

FIG. 1 is a series of views of one embodiment of a no-spill baby bottle nipple in accordance with the present invention, with FIG. 1(*a*) being a cross-sectional view, FIG. 1(*b*) being a top view, FIG. 1(*c*) being a front view, and FIG. 1(*d*) being a perspective view of the nipple; and with FIG. 1(*e*) being a schematic view of various types of openings in the nipple for liquid flow.

FIG. 2 is a series of views of a further embodiment of a no-spill baby bottle nipple in accordance with the present invention, with FIG. 2(*a*) being a cross-sectional view, FIG. 2(*b*) being a top view, FIG. 2(*c*) being a front view, and FIG. 2(*d*) being a perspective view thereof.

FIG. 3 is a series of views of a further embodiment of a no-spill baby bottle nipple in accordance with the present invention, with FIG. 3(*a*) being a cross-sectional view, FIG. 3(*b*) being a top view, FIG. 3(*c*) being a front view, FIG. 3(*d*) being a perspective view, and FIG. 3(*e*) being an enlarged partial top view thereof (without the openings of FIG. 1(*e*).

FIG. 8 is a series of views of a soft lid portion for attachment to a hard ring to form a cap for a drinking product for use by older children and adults. FIG. 8*a* illustrates a top view of the soft lid, with FIG. 8*b* being a perspective view, FIG. 8*c* being a back view, and FIG. 8*d* being a side view thereof FIG. 8*e* illustrates a top view of the soft lid attached to a hard ring for attachment to the drinking cup.

FIG. 9 is a series of further views of the soft lid portion of the cap of the drinking product of FIGS. 7 and 8, with FIG. 9*a* being a first cross-sectional view and FIG. 9*b* being a second cross-sectional view along the sections shown in FIG. 9*c*, which is itself a top view of the soft lid.

FIG. 10*a* is a top view of drinking product of FIG. 9, when the cap is attached to the liquid holding portion of the drinking vessel (e.g. a cup). FIG. 10*b* is a side view of the drinking product of FIG. 10*a*, and FIG. 10*c* is a back view.

FIG. 12 is a series of additional views of the drinking product of FIG. 10. FIG. 12*b* is a cross-sectional view of the product of FIG. 10*b* along the section as shown in FIG. 12*a*. FIG. 12*c* is an enlarged view of the area marked "Detail C" in FIG. 12*b*, showing the details of the upper valve of the spout.

DETAILED DESCRIPTION OF THE INVENTION AND THE PREFERRED EMBODIMENTS

Figure 4:
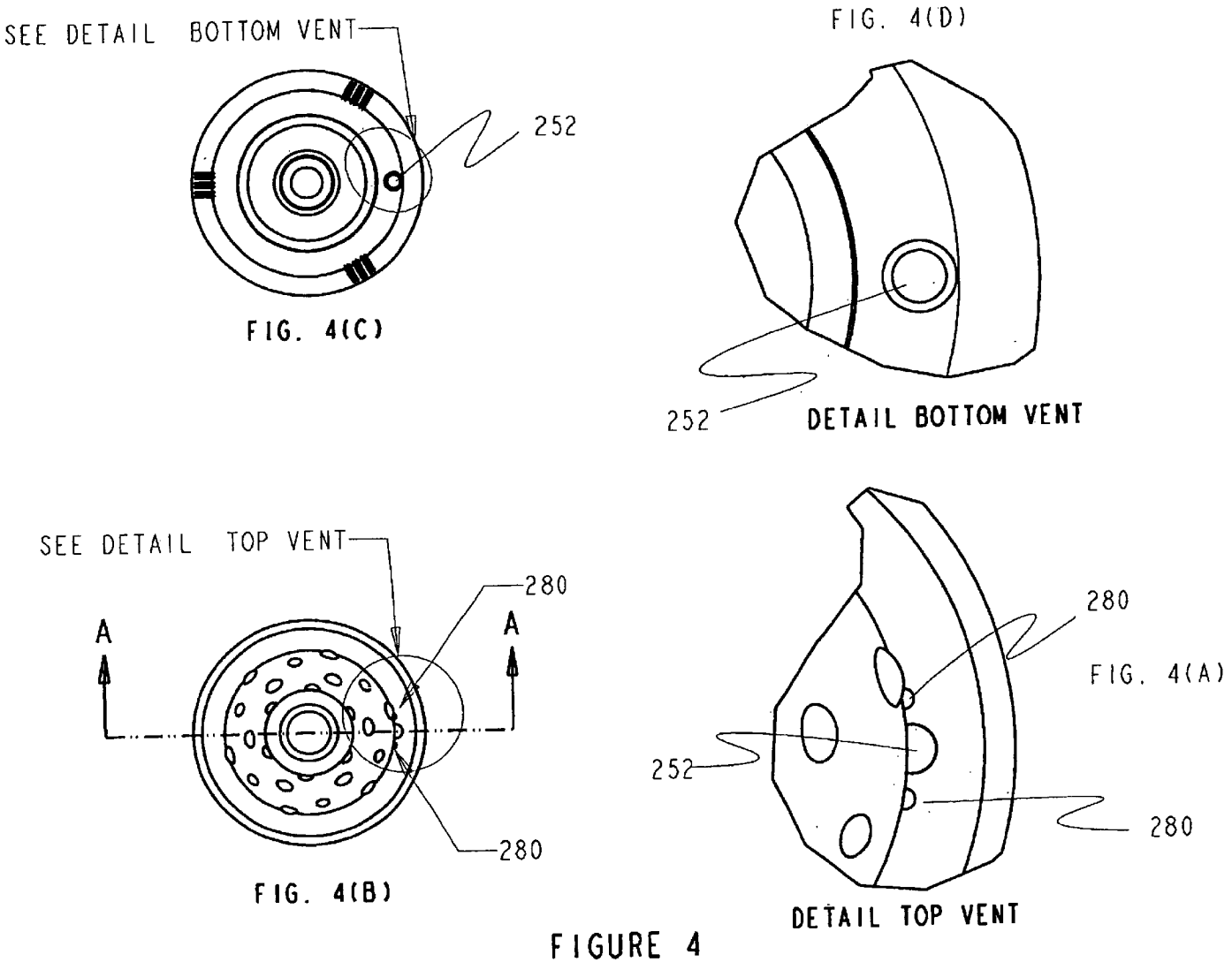
FIG. 4 is a series of views of a further embodiment of a no-spill baby bottle nipple in accordance with the present invention, with FIG. 4(*a*) being an enlarged partial top view of the vent shown in FIG. 4(*b*), FIG. 4(*b*) being a top view of the nipple, FIG. 4(*c*) being a bottom view of the nipple, FIG. 4(*d*) being an enlarged partial bottom view of the nipple, with the vent shown in FIG. 4(*c*), FIG. 4(*e*) being a cross-sectional view, and FIG. 4(*f*) being an enlarged cross-sectional view of the vent shown in FIG. 4(*e*).

Further to the present invention, improved drinking products are provided as discussed herein. The no-spill products of the invention include various embodiments of drinking vessels having no-spill valves as discussed below. These drinking vessels include baby bottle nipples for use by infants, or caps with a spout for use by children or adults.

The embodiments of the drinking products with a nipple are, of course, provided for use by babies. The drinking vessels with a spout can be used by any age and in conjunction with any desired activities. The spout is preferably a soft spout which is part of a soft lid, e.g. a lid and spout made of silicone.

If desired, the embodiments of the drinking cup can be used as a "trainer cup" for the transition period when a child moves from drinking out of a baby bottle to drinking out of a cup. During this period, the child can learn to drink from the cup while the parent need not worry about spillage, due to the presence of the no-spill valve. Alternately, the embodiments of the drinking cup can also be used for cups for adults. The present drinking vessels can be provided for use in ordinary activity, during athletic events, or in any other desired context.

In addition, the drinking vessels can be sold or provided empty, for the user to fill with liquid. Or, they can be sold or provided pre-filled with liquid. For example, they can be used to replace the beverage containers sold in stores that have water, soda, juice, sports drinks, or any other desired liquid, pre-filled therein.

The no-spill products of the invention are each provided with one or more suitably designed no-spill valves. Preferably, the valves themselves are constructed of a flexible material (also referred to herein as a membrane). Thus, a flexible valve can be attached to a rigid material, if desired. Further preferably, however, the valve is part of portion of a cap which is also flexible, such as a soft lid or a baby bottle nipple. The valve is designed to allow fluid flow therethrough when the user is drinking, but is also designed to prevent flow of liquid when drinking is not taking place.

In the preferred embodiments of the invention, the valve is designed to be highly effective against spillage. In these embodiments, liquid flows comfortably through the flexible material during drinking. However, when drinking is not taking place the valve seals tightly against liquid flow. This seal is sufficiently effective such that liquid will not flow even under extremely vigorous shaking.

Further according to the preferred embodiments, the invention is designed such that compression is necessary for fluid to flow through the valve. Further preferably, both compression and suction (negative pressure) are applied by the user for optimal results. Thus, the user compresses the flexible material of the valve with his or her mouth, and also applies negative pressure (suction) at the top of the valve to achieve comfortable liquid flow.

Any suitable flexible material can be used, such as silicone, latex, rubber, plastic, or so forth. In the case of a bottle nipple, for example, the nipple can be constructed out of any of the flexible materials currently used in the art of baby bottle nipple construction, or any other suitable flexible materials for use in such a nipple. Such materials are preferably soft, elastic, and made of a material which is harmless to the user. Particularly in the case of the nipple, such materials are sterilizable (preferably by boiling). The materials may also be transparent or translucent, as desired. Likewise, the same types of materials can be used for the soft spouts and lids of the present invention.

FIGS. 1–7 describe the invention is described in conjunction with examples of embodiments of no-spill baby bottle nipples (and their associated baby bottles) for infants. FIGS. 8–12 describe the invention in conjunction with preferred embodiments for use as other no-spill drinking vessels for any age, whether for a child or an adult.

With respect to the baby bottle nipples of the present invention, a nipple is provided for a baby bottle, the nipple having a no-spill valve therein, as shown for example in FIGS. 1 and 3. The nipple itself is made of a flexible material, and has the no-spill valve provided inside the nipple. With respect to the other drinking vessels of the invention, a valve can be attached to the vessel (e.g. to a hard spout), or more preferably is part of a soft spout in a soft lid which is part of the vessel's cap.

For the no-spill products of the invention for babies, a no-spill nipple is provided for attachment to a baby bottle. Such bottles (or cups) are known in the art, and are used for a baby to drink therefrom during the years when the baby is nursing. They are generally made of a plastic or glass material, and are usually cylindrical in shape, although bottles of any suitable material or shape can be used consistent with the invention.

For babies, the invention provides both protection against leakage or spilling of liquid that would require cleanup by the care giver, and also protects against liquid leaking into the baby's mouth if the baby falls asleep while drinking the bottle. With a regular bottle, if the baby were to fall asleep while the bottle were in his or her mouth, any liquid that leaked out could potentially choke the baby.

Also, in accordance with the invention, the baby controls the amount of liquid he or she needs, when he or she needs it. With a regular nipple, the mother controls it by purchasing a preemie, slow, medium or fast flow nipple. She may also control the flow by purchasing a water, milk, formula or juice nipple. In contrast, the valve of the invention allows the baby to naturally can regulate the amount of fluid he or she needs. In addition, the nipple operates in a comfortable, natural manner, like when the baby naturally extracts milk from mother's breast. The end of the nipple rests on the back of the baby's tongue, and when the baby thrusts the back of his tongue upward and sucks, the milk releases into the baby's mouth the same as with drinking from the mother's breast.

The nipple of the present invention is preferably removably attached to the baby bottles, as is currently known in the art. For example, in the common design currently in use, a flexible nipple is attached to a hard screw-ring to form a cap for a baby bottle, with the nipple protruding through the hole in the screw ring. The screw ring includes screw threads for engagement with a series of screw threads on the baby bottle, so as to screw that cap onto the bottle. The nipple further includes a bottom rim, such as rim 38 or 338. When the hard cap having the nipple attached thereto is screwed onto the baby bottle, the bottom rim of the nipple is compressed between the top of the bottle and the bottom of the hard cap to further secure the nipple in the cap.

For the other no-spill drinking products of the invention, the product preferably includes a soft lid 480 which attaches to a screw ring 468 to form a cap 466. The soft lid 480 preferably includes a recess 478 so that the soft lid can be attached to the screw ring 468, in the same manner as previously discussed for a nipple is attached to a screw ring for a baby bottle.

In the preferred no-valve of the nipple and soft spout, the flexible material of the valve is provided with a depression or dimple therein. This depression (also referred to herein as an indentation) extends downward into the nipple or spout between the nipple or spout's outer walls, and is preferably provided in or near the tip of that nipple or spout. For example, a concave surface can be provided as the depression, such as concave surface 20 of FIG. 1, or a depression of another shape can be provided, such as the depression shown in FIGS. 6 and 11–12 herein. Although FIG. 1 illustrates one embodiment of the invention, preferred embodiments of the invention are shown in FIGS. 3–7 herein for the nipple, and in FIGS. 8–12 for the other drinking products.

The depression of the upper valve is preferably formed and molded to the inside of the upper part of the nipple or spout, preferably inside the nipple or spout's tip. Alternatively or additionally, as discussed below, a bottom valve can be provided at the bottom of the baby bottle nipple (e.g. in the nipple's bottom rim or in the soft lid), whether in addition to this upper valve at the tip or even instead of this upper valve at the tip. Thus, an upper valve can be provided or a bottom valve can be provided, or both.

As a part of the upper valve, the depression of the flexible material is provided with an opening for the passage of liquid, the liquid only passing through the opening when a user is drinking. With reference to FIG. 1, for example, the flexible material of the nipple is provided with an depression such as concave surface 20, the depression being provided with an opening 26 therein. Preferably, this opening 26 is provided in the bottom 22 of the depression of the nipple.

Figure 7:
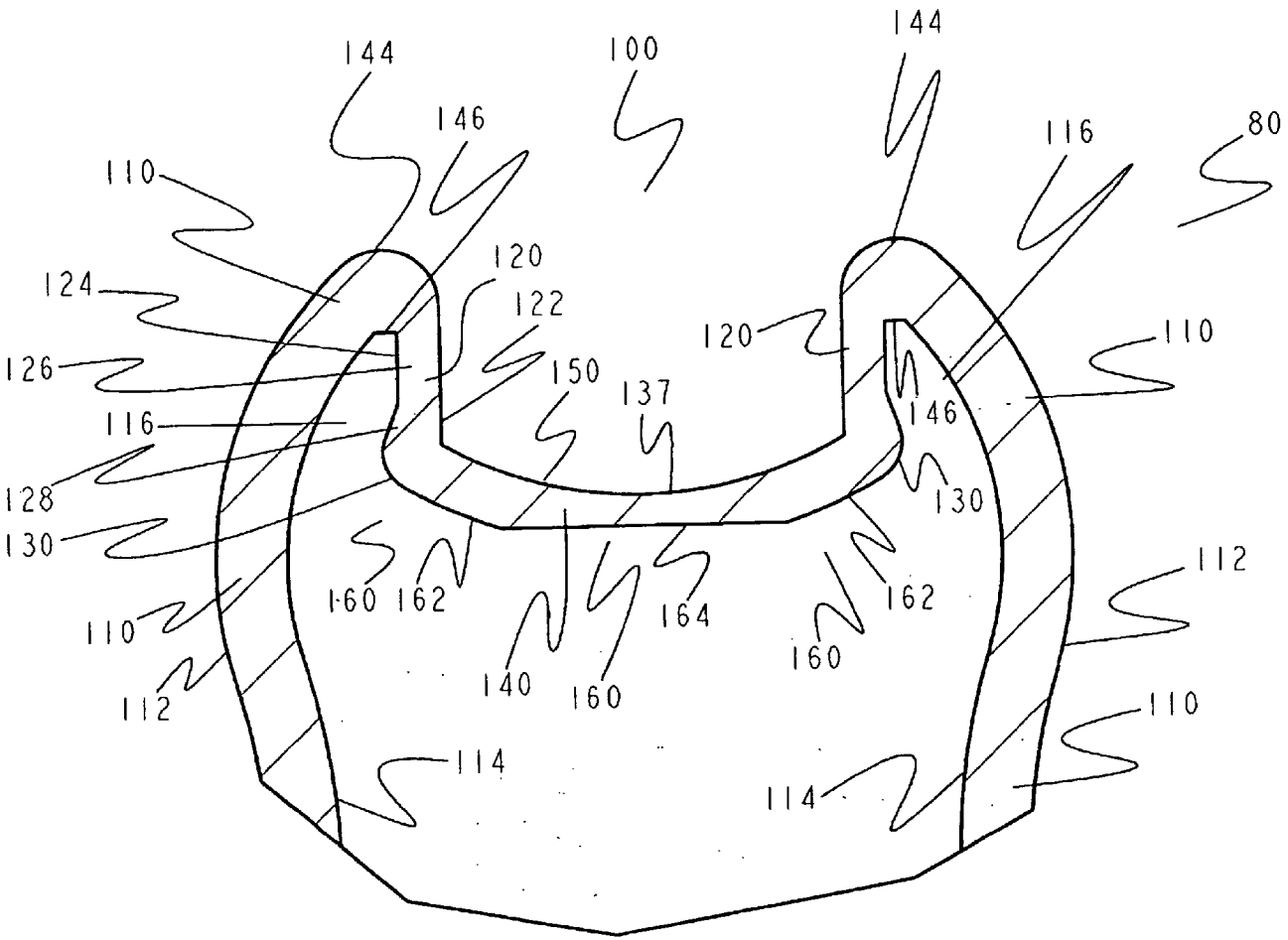
FIG. 7 is an enlarged cross-sectional view of the valve of the preferred embodiment of FIG. 6, in the tip of a baby bottle nipple.

The depression or indentation in the nipple can have various shapes or configurations consistent with the invention. For example, this depression can have a bottom surface 22 which is rounded as shown in FIG. 1(*a*), although this configuration provides only a limited degree of no-spill protection. Preferably, a bottom surface is provided as shown in FIG. 7, and as discussed further below.

Figures 11, 11A, 11B, 11C, 11D:
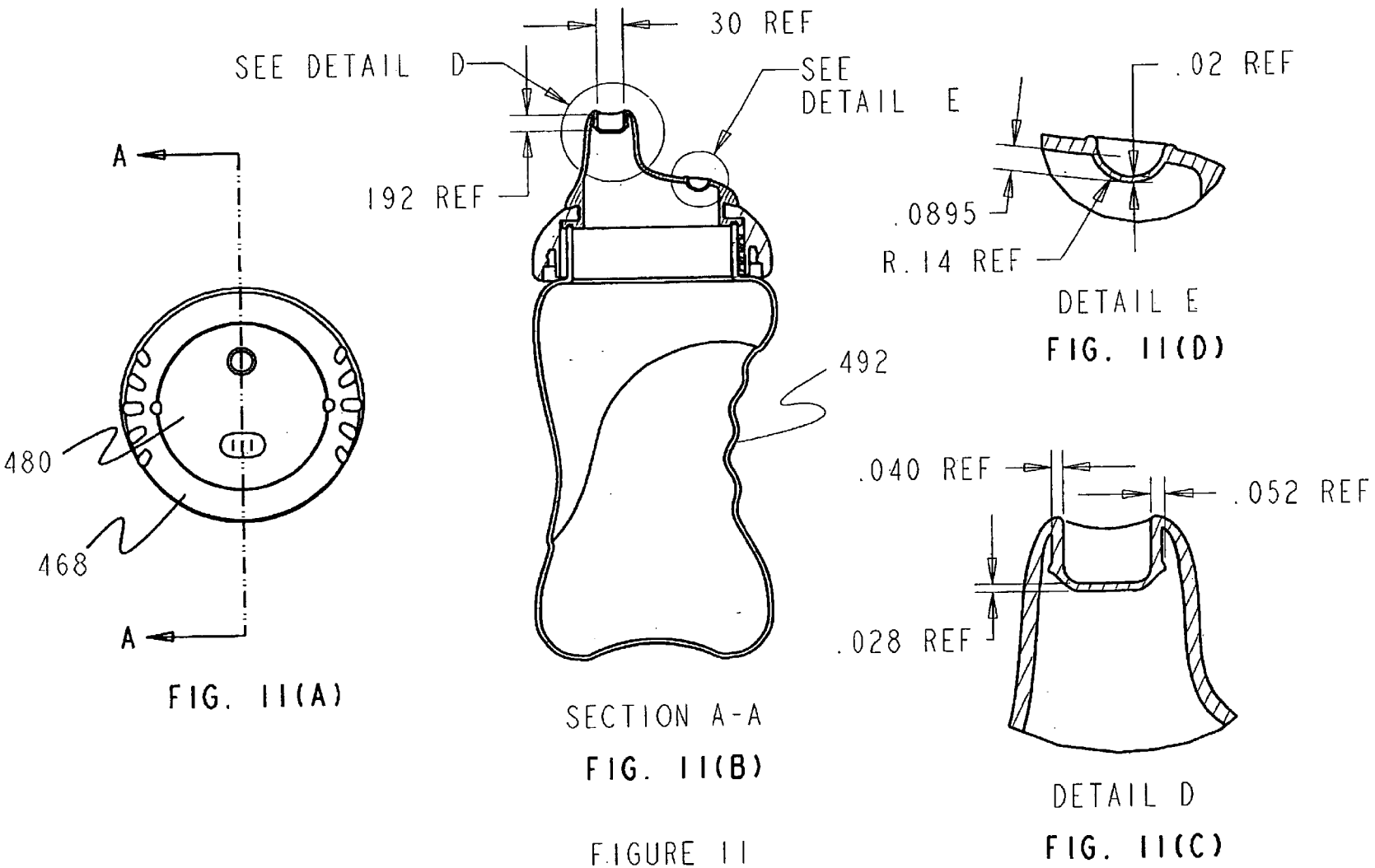
FIG. 11 is a series of additional views of the drinking product of FIG. 10.
FIG. 11*b* is a cross sectional view of the product of FIG. 10*b*, along the section as shown in FIG. 11*a*.
FIG. 11*c* is an enlarged view of the area marked "Detail D" of FIG. 11*b*, showing the details of the upper valve in the spout.
FIG. 11*d* is an enlarged view of the area "Detail E" of FIG. 11*b* showing the details of the air valve in the soft lid.

Likewise, the wall 42 of the depression can have various configurations, such as the rounded wall 42 shown in FIG. 1(*a*) or the non-uniform wall 342 shown, for example, in FIGS. 3(*a*), 6, 7, 11 and 12 as further discussed below. These modifications to the shape of the wall can be used to alter flow rate and sealing characteristics at the nipple opening. The shape of the valve of FIG. 7 is preferred for the nipple for babies and that of FIGS. 11–12 are preferred for the products for older children and adults.

Various different types of openings can be used consistent with the invention. For example, as shown in FIG. 1*e*, the openings can include, but are not limited to, a single slice (i.e. a single slit) as in FIG. 1*e*(1), a cross-cut as in FIG. 1*e*(2), or a "Y" cut as in FIG. 1*e*(3). Or, openings in the form of multiple slits can be provided such as the openings of FIGS. 1*e*(4), 1*e*(5) and 1(*e*)6, or so forth. For example, the opening of FIG. 1*e*(4) includes at least two cross-cuts; and the opening of 1(*e*)5 includes a first horizontal slit with a vertical slit above it and a vertical slit below it (those two vertical slits not intersecting the horizontal slit, unlike a cross-cut). The opening of FIG. 1(*e*)6 includes four slits each slit positioned in the corner of a plus sign, but wherein the four slits do not intersect, unlike a cross-cut. Or, a "T" shaped opening can be used (not shown in the figures). Any other type of opening can also be used, including any combination of holes, slits, or so forth. The type of openings, number of openings, their size, and so forth can be adjusted to achieve the desired flow rate of the product.

In the preferred embodiment of the nipple, a cross-cut is used as in FIG. 1*e*(2) although, of course, it is not intended that the invention be limited to the preferred embodiment. In the preferred embodiment, the dimensions of the cross-cut are 0.13 inches, i.e. the "plus sign" of the cross cut is made of two intersecting slits, each slit being 0.13 inches in length. This sized cross-cut is preferred since it eliminates or minimizes leakage when the bottle is turned upside down or is shaken. However, it will be understood, of course, that the invention is not limited to the dimensions of the preferred embodiment, and is not intended to be so limited. In an alternate embodiment, for example, the dimensions of the cross-cut are 3/32 of an inch, i.e. the "plus sign" of the cross cut is made of two intersecting slits, each slit being 3/32 of an inch in length.

The cross-cut makes it very easy for a baby to draw liquid from the nipple. Moreover, when the child is drinking from the bottle, any excess liquid that is left within the concave area is retracted back into the bottle by the vacuum or suction that the child has produced through the normal drinking process.

In addition, with the design of the preferred embodiment of the nipple, the nipple virtually becomes a variable flow bottle nipple. Numerous nipples are currently sold by flow rate (e.g. slow, medium and fast flow). In the present nipple, due to the fact that a cross-cut is preferably provided in the bottom of the depression, the design of the nipple allows the child to control the amount of fluid he or she needs. More specifically, whether a baby is two days old or one year old, the flow rate of the liquid that is extracted from the bottle is controlled by the amount of pressure that the child exerts at area 36 coupled with the amount of suction that he or she applies when drawing liquid from the vessel. This reduces or negates the need for nipples to be sold with multiple or various size holes.

In the preferred embodiment of the other drinking products at least one slit is provided as the opening 437 as shown for example in FIG. 10*a*. Preferably, three slits are provided, although more or less can be provided as desired (e.g. one or two slits, or four slits, or so forth). When the user puts the drinking vessel in his or her mouth, the slits are oriented vertically (up and down). The grips 492 and shape of the spout are used to orient the spout so that it is only put in the user's mouth in one direction, i.e. that having the slits oriented vertically.

In the soft spout, each slit is preferably 0.125 inches in length. Preferably three slits are provided, spaced preferably 0.0900 inches apart. As previously mentioned, however, the present the invention is, of course, not limited to the dimensions of the preferred embodiment.

During the normal feeding process, a user compresses (i.e. squeezes or depresses) an area on the tip of the nipple or spout with his or her tongue. This area is preferably at the tip of the nipple or spout and is preferably a slightly widened or bulging portion of that tip. As further discussed below, when this area is depressed, the bottom of the depression of the upper valve is squeezed or compressed, so that the opening in that bottom is opened up allowing liquid to flow freely through the nipple or spout.

The nipple or spout further includes a base, such as base 32 of the nipple. If a user merely squeezes the nipple or soft spout in that area or anywhere below the bottom wall of the depression (for example, between the bottom of 36 and base 32, or somewhere along base 32), liquid will not leak from the vessel.

This feature of the present no-spill nipple is in contrast to standard nipples. Standard nipples have convex outer surface, i.e. a rounded spherical tip, as shown by the dotted lines "V" in FIG. 1(*a*). On such standard nipples, if you squeeze anywhere on the nipple (even with nipples utilizing a cross-cut), the nipple will pour fluid from the bottle. This feature further allows the bottle to be used as a teether with teething bumps placed in that area, since merely compressing that area will not result in leakage of liquid.

Figures 6, 6A, 6B, 6C, 6D, 6E, 6F:
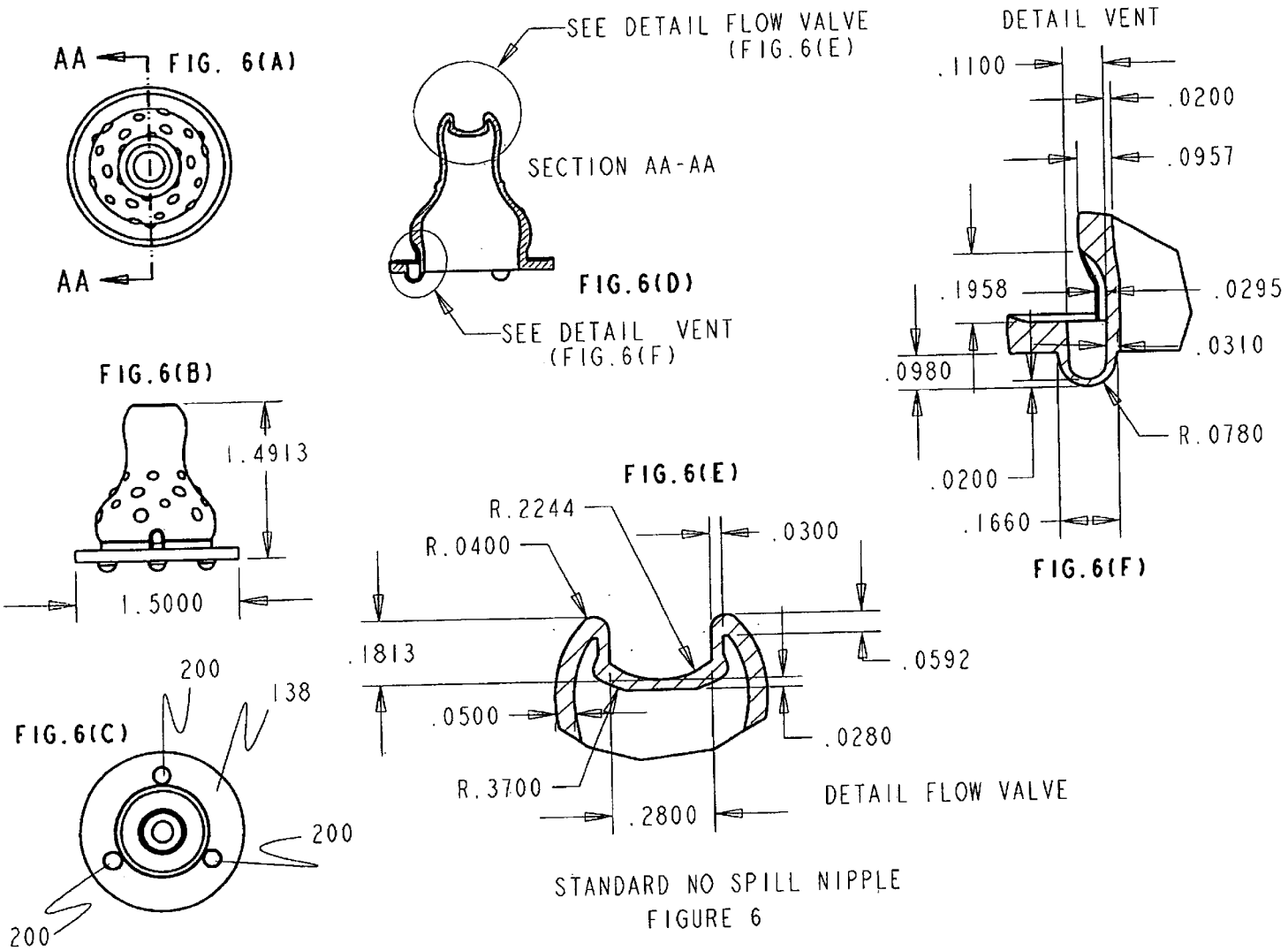
FIG. 6 is a series of views showing a preferred embodiment of the nipple of the no-spill baby bottle of the present invention, including preferred dimensions thereof.
FIG. 6*a* is a top view of the nipple.
FIG. 6*b* is a front and back view.
FIG. 6*c* is a bottom view.
FIG. 6*d* is a cross-sectional view along the section lines shown in FIG. 6*a*.
FIG. 6*e* is an enlarged view ("exploded view") showing further details of the valve as circled in FIG. 6*d*.
FIG. 6*f* is a enlarged view showing further details of the air vent, as also circled in FIG. 6*d*.
Figures 6G, 6H:
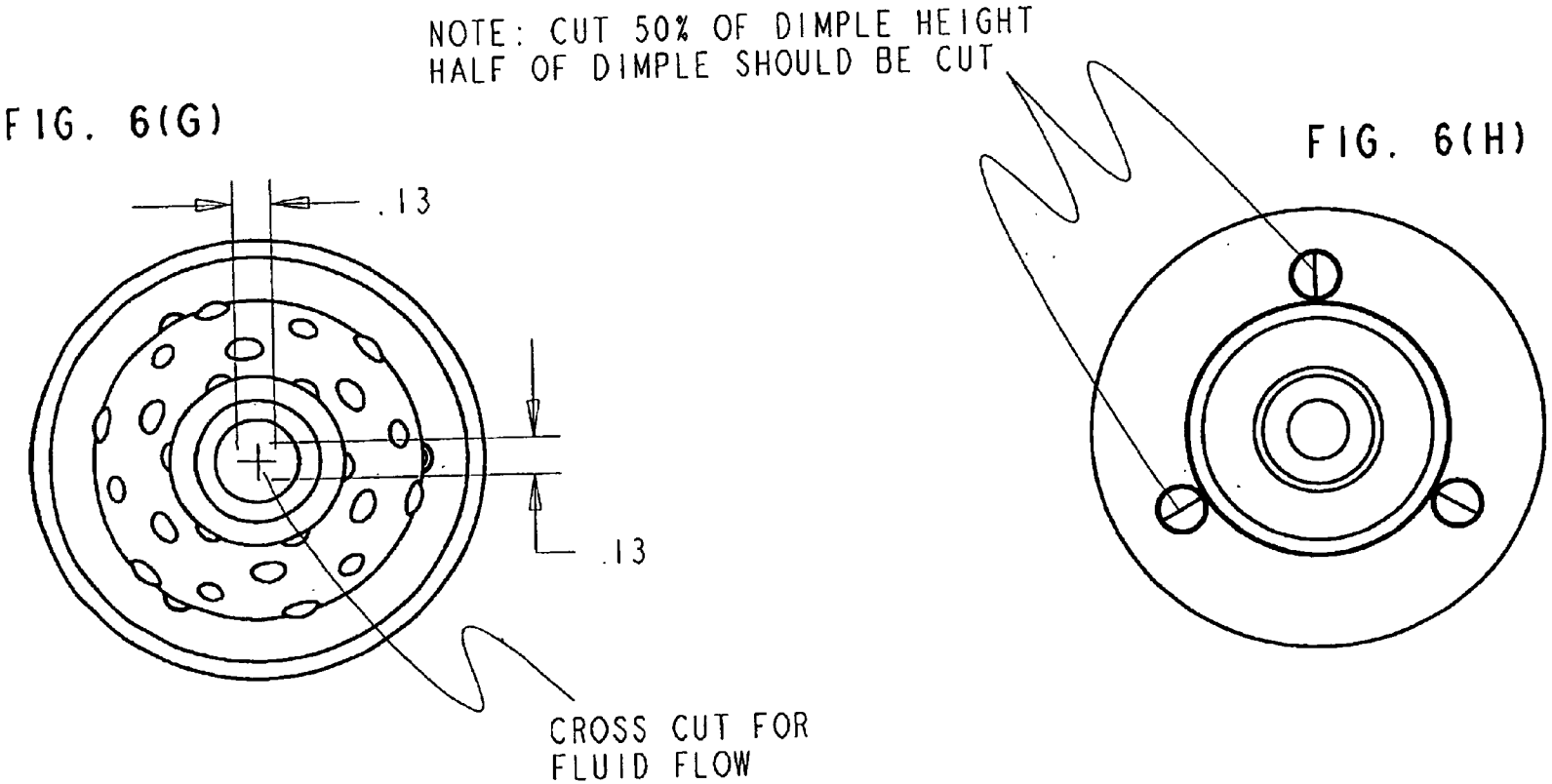
FIG. 6*g* is a further top view of the nipple.
FIG. 6*h* is a further bottom view.
Figure 6:
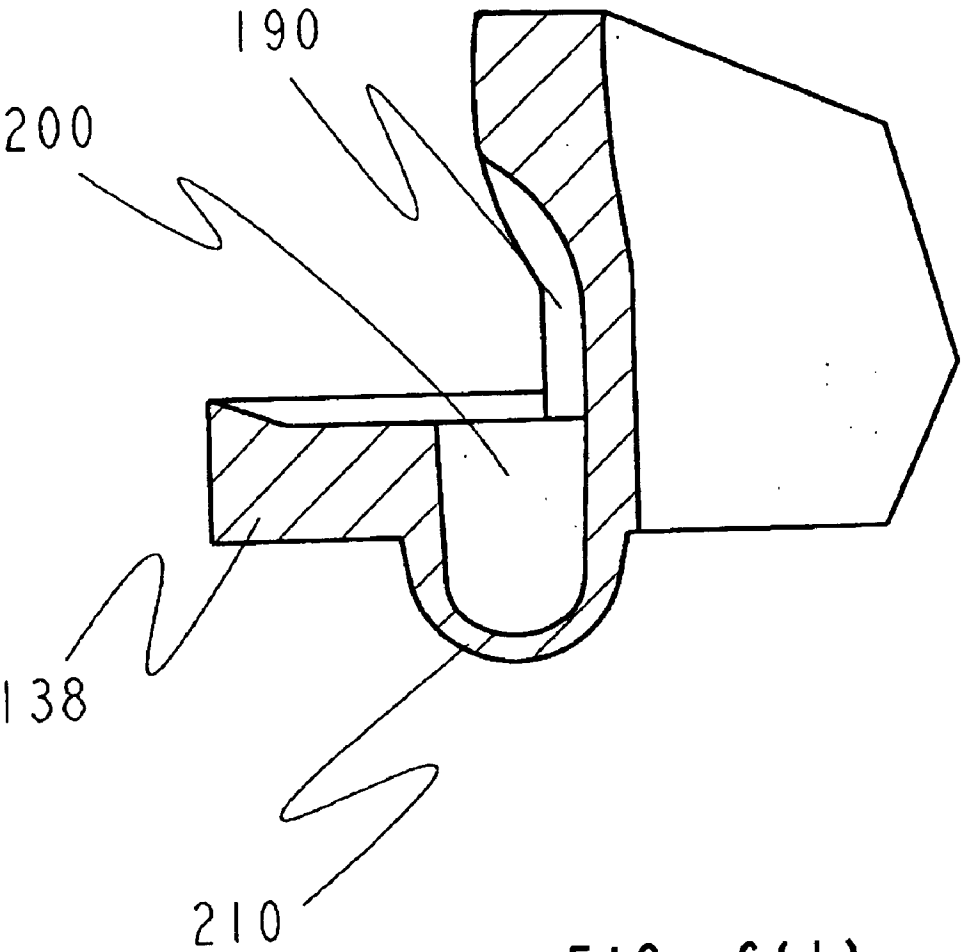

The invention is further effective when used in conjunction with a bottom valve, illustrated for example, by FIGS. 3*a*, 6*f* and 11*d*. In FIG. 3, for example, in a fashion analogous to FIG. 1, compression by the baby is effected on widened area 368 of nipple 318 to compress the bottom 222 of the depression, so that an opening in that bottom is opened to allow liquid flow. A bottom valve, preferably in the bottom rim of the nipple (or in the soft lid of the spout) is provided for air flow into the nipple (or into the soft lid). Squeezing the nipple outer wall below the bottom 222 of the valve will not open the opening in valve bottom wall. In the embodiment of FIG. 3, the bottom wall has a concave surface 320 which is concave on the top only, as further discussed with reference to FIG. 6. When the nipple outer wall (or spout outer wall) is compressed at the bottom wall of the upper valve, and negative pressure is applied by the user at the nipple or spout tip, the opening in the upper valve and the opening in the bottom valve (air valve) both open. As a result, the combination of compression and sucking (negative pressure) results in comfortable liquid flow.

Any of the traditional nipple sizes can be used with the nipple embodiments of the invention. For example, the nipple can be a regular nipple as shown in FIG. 1, or a wide neck nipple as shown in FIG. 2, or so forth. Regular nipples are used with standard bottle necks (e.g. bottle necks approximately 1.406 inches in diameter), and wide neck nipples are used with wide neck bottles (e.g. bottles with bottle necks approximately 2.04 inches in diameter). Alternatively, a bottle with any other neck size can be used consistent with the invention. In addition, although the nipples of FIGS. 1 and 2 are used with one embodiment of the valve, preferably, the regular or wide neck nipples of the invention (or any other neck sized nipple) are used with the valve shown in FIGS. 3, 6 and 7. For the spouts any sizes can be provided which are comfortable for the intended user.

Thus, in accordance with the invention, a valve is provided in the form of a depression (i.e. an indentation) in the flexible material tip of a nipple or a soft spout, the depression having an opening for the selective passage of liquid. This construction, as further described below, results in a preferred no-spill valve which seals tightly when the nipple is not in use, but which passes liquid easily when a user sucks on the membrane (e.g. on a nipple or spout).

The structures of the preferred embodiments of the upper valve of the invention are shown, for example, in FIGS. 3*a* and 6 with respect to the baby bottle nipple, and in FIGS. 8–9 and 11–12, with respect to the soft spout. The preferred construction of the upper valve of the nipple is similar to that of the spout. In the baby bottle nipple the tip is circular, however, whereas in the soft spout the tip is oval.

Likewise, a different shape is used for the body of the nipple as opposed to the shape of the soft lid. However, if desired, the upper valves used in FIGS. 3*a* and 6 can be used in the baby bottle nipple or in the soft spout, and likewise, the upper valves of FIGS. 8–9 and 11–12 can be used in the soft spout or the baby bottle nipples.

In general, the drinking products of the present inventions are designed to be very effectively non-spill, while still very comfortable to drink from. For example, if you make it too easy for a child (or other user) to extract liquid from a product, then it will usually leak easily. On the other hand, if the product is too securely designed to prevent emergence of liquid, then it can result in a situation where the user cannot drink liquid easily, or at all. If too much force is needed to drink, this is a particular problem when the user is a baby. Similarly, though, it can also be uncomfortable for users of any age. Thus, the present inventions have been designed to appropriately balance both effective sealing and comfortable flow of liquid.

In accordance with the objectives of the invention, the upper valve must sufficiently seal such that liquid will not emerge from the valve, even upon vigorous shaking. At the same time, it must be feasible to drink liquid from the device under the normal forces and pressures exerted by the mouth of a baby or older user (depending on who the product is provided to), so that drinking is comfortable. It will, therefore, be appreciated that the optimal balance of sealing and opening must be achieved for a maximally effective no-spill valve.

The specific combination of features of the inventions have been designed to achieve these objectives. The structures of the preferred embodiments of the nipple and spout have been provided which are believed to provide the optimal balance desired. The valves in those products have been specifically shaped to provide structures which both allow very comfortable drinking and very effective sealing. Moreover, such factors as the relative thicknesses of the parts and so forth have also been developed to achieve optimal operation. For example, if the bottom wall of the valve is too thin, the product will leak when turned over or shaken, while, if the bottom wall is too thick, it will be too difficult to flex the bottom wall by application of negative pressure, and therefore, will be too difficult to part the opening so as to allow liquid therethrough. Likewise, if the sidewalls are too thin, the negative pressure on the valve when the user sucks out liquid can invert the valve, i.e. can pull the sidewalls up and out, to pull the bottom wall out from the interior of the nipple or spout. However, if the sidewalls are too thick, the valve will not open when the user bites down and sucks on the top of the nipple or spout.

The valve is initially described with respect to its use in a baby bottle nipple, with respect to upper valve 100 of the baby bottle nipple of the invention are shown in FIGS. 3, 6 and 7 herein (with the upper valve also being referred to the liquid valve herein). FIGS. 3, 6 and 7 illustrate the embodiment of the liquid valve having the preferred shape for maximizing the no-spill properties of the nipple. However, this same shape valve can also be used in the spout of the other drinking products of the invention, as discussed below.

Accordingly, the discussion provided herein with respect to the baby bottle nipple applies well to the spout embodiments as well, with preferred variations for the soft lid being shown in the figures and/or referred to herein. For ease of reference, analogous parts of the baby bottle nipple and soft lid are usually referred to herein by similar reference numerals, the reference numerals of the nipple and the spout usually being about three hundred numbers apart. Thus, for example, upper valve 100 of the nipple can be compared to upper valve 400 of the soft spout; nipple outer wall 110 can be compared to soft lid outer wall 410; and so forth.

As shown in the figures, nipple 80 includes a liquid valve 100 in the form of an depression in the top of the nipple. This depression or indentation can be compared to a valley formed in the tip of the nipple, the preferred structure of the depression being shown, for example, in FIGS. 3*a* and 3*b*, and in FIG. 6.

The top portion of baby bottle nipple 80 is tip 70. Tip 70 preferably includes a slightly widened diameter portion (a bulge on the outer wall) 68. Alternatively, a straight tip could be provided if desired. Tip 70 of the nipple in turn leads to a neck 72, which leads to a base portion 76.

Liquid valve 100 is preferably provided within the tip 70. Further preferably, the bottom of the valve is in the vicinity of the widened diameter portion 68. Alternatively, the valve can extend further down into the nipple, e.g. to have its bottom in the neck or in the base, but such embodiments are not preferred.

In the preferred embodiments, the upper valve is provided high in the nipple or spout. That location, for example, is believed to be better positioned for optimal functioning in conjunction with the placement of the user's teeth and tongue on the nipple, and the movement of those teeth and tongue of the user during the drinking process, both for comfortable drinking and for optimal no-spill characteristics. This upper valve is preferably in the tip 70, i.e. the top of the nipple (which is usually bulbous, but does not have to be). Preferably, the bottom wall of the valve is at or near the widest (e.g. bulge 68 or 368) of that bulb. For example, the bottom wall can be right above, right at or right below that bulge. Or, the bottom wall can be below the top rim of the nipple 144 or between that top rim and the bulge. Likewise, similar placement in the tip of the spout is preferred as well, e.g. at the bulge, or right above or below it, or between the bulge and the top rim of the spout, or so forth. If the tip of the nipple or spout is straight, high valve placement is still preferred. For example, in the straight or bulbous tip nipples or spouts, the bottom wall can be located in the upper half of the tip of the nipple or spout; or in the upper quarter of the entire nipple or entire spout; or in the upper third or upper eighth of the entire nipple or spout, or so forth.

Alternatively, in less preferred embodiments, the bottom wall of the upper valve can be in the neck 72 of the nipple, or low in the spout of the soft lid. In a much less preferred embodiment, the bottom wall can be at the intersection of the neck 72 and the base 76 of the nipple (or the intersection of the spout and the base of the soft lid), or below that intersection in the base itself of the nipple or the base itself of the soft lid. However, such low valves are not preferred, since they are not as effective to provide no-spill properties.

In addition, when a low valve is provided in the form of a deep depression, some liquid is more likely to be trapped inside the valley or trough during the drinking process. When the child is drinking and the bottle is tilted upside down, liquid will flow into the depression and then into the child's mouth. When the bottle tilts right side up again as it is taken out of the child's mouth, some liquid will remain in the valley or trough. This effect is undesirable in a no-spill nipple, as this liquid in the depression is above the opening of the valve, and therefore, can spill out of the depression. Furthermore, having this liquid exposed in the depression for an extended period to the air is unsanitary and undesirable, as dirt or dust or other contaminants can get into it. A high valve has been found to minimize these effects and to provide a more effective no-spill function.

Moreover, a high valve is easier to clean. A valve in the form of a deep depression (e.g. to the neck or base vicinity), results in an extended valley or trough down the neck of the nipple. Such a valley is harder to clean effectively, which is also not preferred.

Nipple 80 includes nipple outer wall 110 having an outer surface 112 and an inner surface 114. The outer surface 112 of the nipple is the surface that the child will place his or her mouth onto to drink from the nipple. The inner surface 114 is the surface inside the nipple that liquid will flow along when the child is drinking.

In standard bottle nipples, the top of the nipple is a spherical surface with an opening in it, such as the dotted line surface 12 of FIG. 1(*a*). In contrast, in the nipple of the present invention, no flat surface is provided at the top of the nipple 80. Rather, the nipple of the invention has an open top, as shown, for example in FIG. 3(*d*), with the depression extending down into that top.

The outer wall of the nipple is, therefore, preferably, coextensive with the side wall of the depression, such that the outer wall of the nipple curves over and extend downward to lead into the side wall of the depression in the tip, as shown, for example in FIGS. 3(*a*), 4*e*, and 6*e*. The outer surface of the outer wall of the nipple thus curves over and becomes the inner surface of the sidewalls of the depression. Thus, the top of the nipple itself is preferably completely open with no membrane or other section blocking passage of liquid or air through that top.

Valve 100 includes sidewall 120, and a bottom wall 140. The bottom of sidewall 120 is connected to bottom wall 140.

Sidewall 120 forms an tube down into the nipple, as shown for example in FIG. 3*d*. In the preferred embodiment, this tube is symmetrical when viewed from the top. More specifically, in the preferred embodiment of the nipple, the tube is circular when viewed from the top; and in the preferred embodiment of the spout, the tube is in the shape of an oval when viewed from the top. Thus, the valve of the nipple preferably has an upper cylindrical section, and the valve of the spout preferably has an upper tubular section with an oval shape. Alternately, another shape may be provided if desired.

In the embodiment of the valve for the nipple, the upper cylindrical section presents the opening in a configuration suitable for use by a baby due to the fact that the upper cylindrical section is symmetrical with respect to rotation of the baby bottle. Although the bottle will be rotated (twisted) during use, this rotation will not interfere with the orientation of the valve presented to the baby. In other words, since the top of the valve in nipple is circular and has a cross-cut therein, the valve will operate suitably regardless of how much the baby (or his or her care giver) rotates the top during use. (This is in contrast to the embodiment of the soft lid, as discussed below, in which the spout is designed for use in a particular orientation by an older child or adult).

In the embodiment of the nipple, a cross-cut, i.e. a cut in the form of a plus (+) sign, is preferably used for the opening, as shown in FIG. 1*e*(2). With the cross-cut, compression of the nipple wall 110 at the appropriate height along the nipple's outer wall will compress and open one of the slits in the cross-cut regardless of the rotation of the nipple. Thus, in the baby bottle embodiment, a single slit is not preferred. With a single slit, rotation of the nipple could place the slit in a purely vertical orientation or a purely horizontal orientation, or somewhere in between. In the purely vertical position, compression of the nipple wall would open the slit allowing drinking. However, if the nipple were rotated such that the slit happened to be in the purely horizontal position, compression of the nipple walls by the child's mouth would push the edges of the slit against each other, undesirably sealing the slit when the child is attempting to drink.

In the embodiment of the valve for the spout, a single slit is provided. However, the spout is an oval, presenting an elongated shape which is intended to be placed into the mouth in a particular orientation. In this orientation (which is the most comfortable position for the spout to sit in the mouth), the wider side of the oval rests down and the shorter side of the oval extends between the user's tongue and the roof of his or her mouth. Thus, in this position, the slit is oriented vertically in the proper position for use.

Sidewall 120 includes an inside surface 122 and an outer surface 124. Inner surface 122 of sidewall 120 of valve 100 is preferably a smooth vertical surface. A separation (a space) 116 is preferably provided between the outer surface 124 of sidewall 120 and the inner surface 114 of nipple outer wall 110.

Preferably, a ledge 146 is provided to connect outer surface 124 of sidewall 120 to inner surface 114 of outer wall 110. Ledge 146 can be flat or curved or so forth. By providing such a ledge, the outer surface 124 of sidewall 120 does not meet the inner surface 114 of outer wall 110 at a point. Ledge 146 is provided to avoid a potential hinge between the outer surface 124 of sidewall 120 and inner surface 114 of outer wall 110; in other words, to prevent the valve from inverting and being pulled out of the body of the nipple during use. Filling in the point to form a ledge (or other shape) provides addition material which makes this part of the valve stronger, and prevents inversion. It lessens the flexibility of the top of the sidewall of the valve from moving out of the nipple or spout. It may also help open the valve during its operation.

Further preferably, outer surface 124 of the sidewall preferably includes a upper segment 126, and a lower segment 128. Upper segment 126 is preferably a vertical wall. Lower segment 128 preferably includes a protrusion 130.

As shown in FIG. 7, protrusion 130 is a thickened portion of the sidewall which extends sideways, away from upper segment 126 and toward inner surface 114 of nipple wall. Thus, protrusion 130 is preferably provided as a bulge off of the outer surface 124 of the sidewall, at the location where the sidewall 120 meets the bottom wall 140. As shown in FIG. 7, protrusion 130 is preferably rounded. The placement of a protrusion on the outer surface of the sidewall has been found to more effectively transmit force to open the valve during drinking than a straight sidewall.

Bottom wall 140 of valve 100 includes an upper surface 150 and a lower surface 160. An opening 137 extends from upper surface 150 through bottom wall 140 to lower surface 160. This opening connects the interior of the nipple (and the baby bottle), with the exterior environment. Thus, when drinking, liquid flows from the baby bottle through this opening into the mouth of the child.

Opening 137, is preferably placed in the center of the upper surface 150 of the bottom wall 140, and preferably extends straight down to go through flat surface 164 in the lower surface 160. Opening 137 is preferably a cross-cut as in FIG. 1*e*(2) in the embodiments of the invention which are baby bottle nipples; the opening preferably is a slit (or more preferably several adjacent slits) in the embodiments which incorporated into spouts for drinking products for older children and adults. Further preferably, the opening is in the form of three slits in the spout product, as shown for example in FIGS. 8*a* and 8*b*. Further alternate openings for use with either the nipple or the spout of the present invention are shown in FIGS. 1*e*(1) through 1*e*(6).

Upper surface 150 is preferably one smooth continuous surface as shown in FIG. 7. Further preferably, the upper surface is concave, i.e. in spherical and in the orientation of a right-side up bowl. The edge of this bowl contacts the sidewall of the valve. Preferably, the entire upper surface is concave, or, in other words, the upper surface is a concave surface which extends to the inner surface of the sidewall. In a manner of speaking, the tubular upper section of the valve and the bowl-shaped lower portion form something of a bucket.

The use of a concave upper surface improves the no-spill characteristics of the nipple. When the baby bottle is turned upside down, liquid presses on the lower surface 160 of the bottom wall exerting pressure against the upper surface 150 (which is now on the bottom due to the fact that the baby bottle and nipple have been turned upside down). It is believed that, due to the concave shape of the surface 150, this surface acts as a dome, with the pressure of the liquid on the bottom wall forces the sides of this dome together, thereby sealing the opening 137. Thus, this concave shape contributes to the effectiveness of the structure as a no-spill valve to prevent spillage or leakage. These advantages are further enhanced by other aspects of the shape of the valve, as further discussed below.

In one embodiment, the entire bottom wall is concave, such that the lower surface of the bottom wall is also a smooth continuous concave surface, as shown in FIG. 1*a*. However, this embodiment is not preferred, as it has been found that the configuration of the lower surface shown in FIG. 7 significantly improves the no-spill characteristics of the valve.

In this preferred embodiment of FIGS. 3, 6, and 7 (and FIGS. 8–12 with respect to the valves in a spout), lower surface 160 includes an outer surface 162 and a flat surface 164. Outer surface 162 is provided at the periphery of the lower surface 160 and is preferably curved. Further preferably, outer surface 162 is a curved surface which is provided at the circumference of the lower surface 160, and which extends from the protrusion 130 to the flat surface 164. This curved surface very efficiently directs force toward the flat surface having the opening, to open that opening in a very effective fashion. Alternatively, it the outer surface 160 can be straight, although this is not preferred.

In the preferred embodiment, flat surface 164 is provided at the center of lower surface 160. Lower surface 160 is, therefore, preferably provided in a shape which approximates the top of a trapezoid, with the sides of this trapezoid-like shape preferably being curved.

The use of this approximately trapezoidal shape for the lower surface 160 of bottom wall 140 has been found to significantly improve the properties of the valve, substantially enhancing its resistance to any flow of liquid out of the nipple or spout when the user is not drinking therefrom.

When this valve is incorporated into the nipple or spout, the drinking vessel can be shaken vigorously without leakage or emergence of any liquid from the valve.

Preferred dimensions of the nipple and spout products are shown in the figures. Due to the fact that the spout is larger than the nipple and also of a different shape (i.e. with an oval tip as opposed to the round nipple tip), the appropriate thicknesses and dimensions of the individual parts of the spout have to be adjusted accordingly. The thickness, area, specific configuration, and so forth of each of the products influences how that product reacts upon the application biting and negative pressure thereto.

Preferred dimensions for the structure of the valve shown in FIG. 7 are provided in FIG. 6*e*. The thickness of outer wall 110 of the nipple is preferably 0.0500 inches (i.e. the thickness from the outer surface 112 to the inner surface 114 of the outer wall). At the top rim 144 of the nipple, the nipple is rounded with the curvature corresponding to a radius (referred to as "R" in the figures) of 0.0400 inches. From top rim 144 to ledge 146 is a distance of 0.0592 inches.

The upper segment 126 of sidewall 120 of the liquid valve 100 is preferably 0.0300 inches in thickness. On the inside of the valve, the upper surface 150 of bottom wall 140 is preferably concave, with the curvature corresponding to a radius of 0.2244 inches. From the top rim 144 of the nipple to the opening (i.e. the bottom point) of the top surface of the bottom wall is preferably 0.1813 inches.

The inner diameter of the liquid valve is preferably 0.2800 inches. The outer diameter of the liquid valve at its widest point (i.e. from the edge of the protrusion 130 on one side to the edge of the protrusion on the other side) is 0.3663 inches. (For the soft spout it is 0.4040 inches in one direction (that shown in Detail D of FIG. 11*c*) and is 0.6240 in the other direction (that shown in Detail C of FIG. 12*c*), the two directions being provided since that embodiment is an oval). The diameter of the flat surface segment 164 is 0.2000 inches. (It is 0.3393 inches in one direction (the direction of Detail C in FIG. 12*c*) and 0.2101 inches in the other direction (the direction shown in Detail D of FIG. 11*c*), for the embodiment in the soft spout, since that embodiment is an oval). The distance from the center of the top surface of the bottom wall (i.e. where the opening is preferably located) to the center of the flat surface 164 of the bottom surface of the bottom wall is preferably 0.0280 inches. The curved surface at the periphery of the bottom surface of the bottom wall is preferably rounded with a curvature corresponding to a radius of 0.3700 inches. This curvature and combination of curved and flat surfaces has been found to provide an effective functioning of the valve. With too much flat surface on the bottom of the valve, it is easier for the hydraulic pressure of liquid to force the opening in the bottom wall open when the vessel is shaken, as there is more surface area for the liquid to directly push up against to open the slit. Furthermore, the curved surface is believed to deflect the force of the water pushing against the bottom wall, and the symmetrical nature of the hydraulic forces against the symmetrical curved surface surrounding the flat surface are believed to balance each other out. The curved surface is also believed to allow more efficient transmission of force from the protrusion to the flat surface.

As discussed above, in one series of embodiments of the invention, the depression is preferably provided at the top of the nipple. In alternative or additional embodiments of the invention, one or more valves can be placed at the bottom of the nipple (e.g. in the nipple's bottom rim), if desired. These bottom valves are air valves (i.e. valves for allowing air to flow into the nipple) and preferably consist of an opening located in an depression in a flexible material as described above, although alternatively another type of valve can be utilized if desired. The bottom valve can be used in conjunction with a no-spill valve at the tip of the nipple (e.g. the valve described above), or it can be used by itself with a baby bottle nipple having a traditional shaped tip. In the preferred embodiments, the bottom valve is used in conjunction with the improved no-spill valve of the tip described above.

For example, as shown in FIG. 3, a bottom valve 252 or 260 can be placed at the bottom of the membrane of the nipple or spout (with the bottom valve also being referred to herein as an air valve). FIG. 3 shows a nipple for use with a regular neck bottle, although, the invention can of course be used with a wide neck bottle or so forth, as discussed above. The bottom valve embodiments can also be used with those products incorporating a drinking spout.

In the preferred embodiment of the invention which is a baby bottle nipple, the air valve is preferably located in the bottom rim (e.g. bottom rim 38 or 138 or 338). In this embodiment, the air valve 200 is preferably positioned to descend below the nipple's bottom rim and fit inside the neck of the bottle when it is attached to the screw ring to form the cap, which is then attached to the bottle. In the embodiment which is a drinking product with a spout, the valve is preferably a dome located in a soft lid 480.

Air valve 252 is preferably a depression in a flexible membrane, the depression having an opening therein, such as any of the valves previously described for the tip of the nipple. The depression of the valve can be located up against the nipple wall as shown with respect to valve 252, or can be moved over, away from the nipple wall, as shown with respect to valve 260.

One or more air valves can be provided in the nipple. These valve can all be of the same type or can be a mixture of types. In preferred embodiment of the baby bottle nipple embodiment, preferably three air valves are provided for air flow (the valves preferably being spaced 120 degrees apart on the bottom rim of the nipple. In the preferred embodiment of the drinking product with a spout, preferably one air valve is provided. Alternatively, however, more or less air valves can be provided for the nipple or the spout.

In the preferred embodiments of the nipple and soft lid, the depression of the air valve is preferably the shape of an upside-down dome, (i.e. a right side up bowl-shaped depression in the soft lid), as shown for example in FIGS. 6*f*, 8*b*, and 11*d*. Preferably, for the nipple and soft lid, the depression of the air valve is the shape of an upside down dome (i.e. a right-side-up bowl-shaped depression in the nipple or soft lid), as shown for example in FIGS. 6*f*, 8*b*, and 11*d*. This dome is provided with an opening in the bottom, the opening preferably being a slit. The length of the slit is preferably half the height of the dome.

The air valve functions to facilitate the flow of air back into the bottle while the baby is drinking. In other words, as a child draws liquid from the top of the nipple a vacuum is created in the chamber of the baby bottle or other drinking product which in turn pulls open an opening in the air valve, such as a slit or cross-cut in valve 252 (which is preferably smaller than the opening in the valve at the tip of the product). Opening of this air valve enables air to go back into the bottle easier, which in turn makes it much easier for the child to extract liquid through the top of the nipple. A simple slit, such as opening 1 in FIG. 1(*e*) is preferred for this vent to minimize leaking. Valve 260 is another variation on this vent.

Further views showing the air valves are provided in FIGS. 4 and 5. The bottom rim of the baby bottle nipple is usually covered by the hard portion of the screw cap (i.e. the ring which screws on to the baby bottle) which presses against it tightly. If the vent (e.g. 252 or 260) is partially or totally under the hard ring of the screw cap, it is preferred that an air flow mechanism be provided to the air valve. Accordingly, in the embodiments of FIGS. 4 and 5, one or more spacers or channels are provided to allow air to flow into the air valve.

In the embodiment shown in FIGS. 4(*a*), 4(*b*) and 5(*f*) for example, a spacer is provided to hold the top of the nipple's bottom rim away from the bottom of the screw-cap, creating a space between the nipple's bottom rim and the screw cap. This space helps air flow downward under the screw cap into the valve and into the drinking vessel. For example, one or more protrusions or bumps 280 can be provided, as shown, for example by spacer 280 in FIGS. 4(*a*), 4(*b*) and FIG. 4(*f*). Spacer 280 is preferably provided adjacent to or near the air valve, as shown for example by spacer 280 in FIG. 4(*b*) and spacer 280 in FIG. 4(*f*).

Figure 5B:
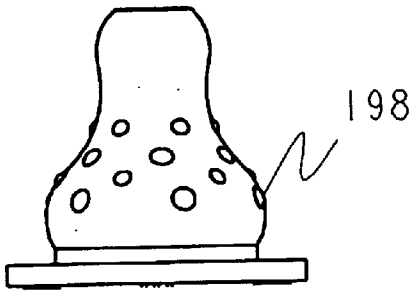
FIG. 5 is a series of views of a further embodiment of a no-spill baby bottle nipple in accordance with the present invention, with FIG. 5(*a*) being a side view, FIG. 5(*b*) being a front view, FIG. 5(*c*) being a bottom view, FIG. 5(*d*) being an enlarged view of the vent shown in FIG. 5(*e*), FIG. 5(*e*) being a cross-sectional view, and FIG. 5(*f*) being a perspective view.
Figure 5A:
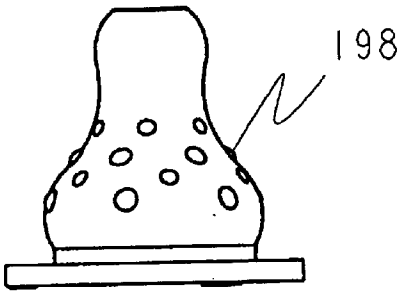
Figure 5C:
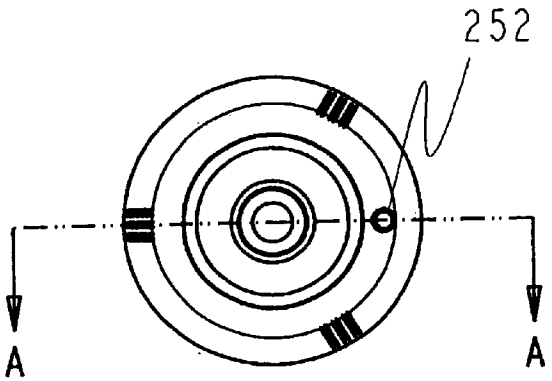
Figure 5F:
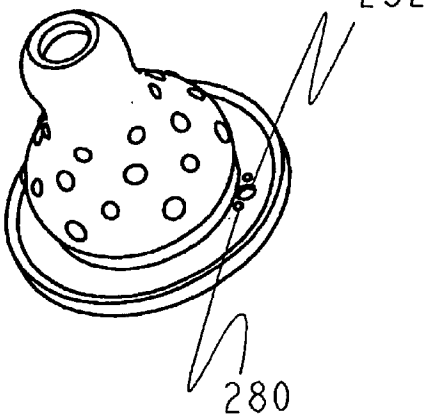
Figure 5D:
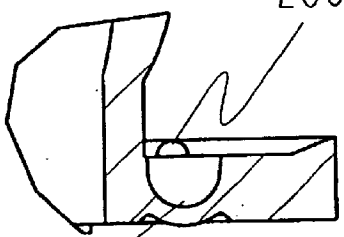

As shown in FIGS. 4*a* and 5*f*, preferably at least two protrusions are utilized. When the nipple is attached to the screw cap, the space between the protrusions ensures that air can flow into the air valve, regardless of how tightly the nipple is attached to the ring of the screw cap.

Instead of placement of the protrusion on the nipple, a protrusion or bump could alternatively be placed on the screw cap ring itself. Placement of the protrusion on the screw cap ring likewise ensures that a space is provided for air flow to the air valve. However, placement of the protrusion on the nipple itself is preferred, so that the nipple can be used with the standard screw cap rings currently available in the market.

Figures 4E, 4F:
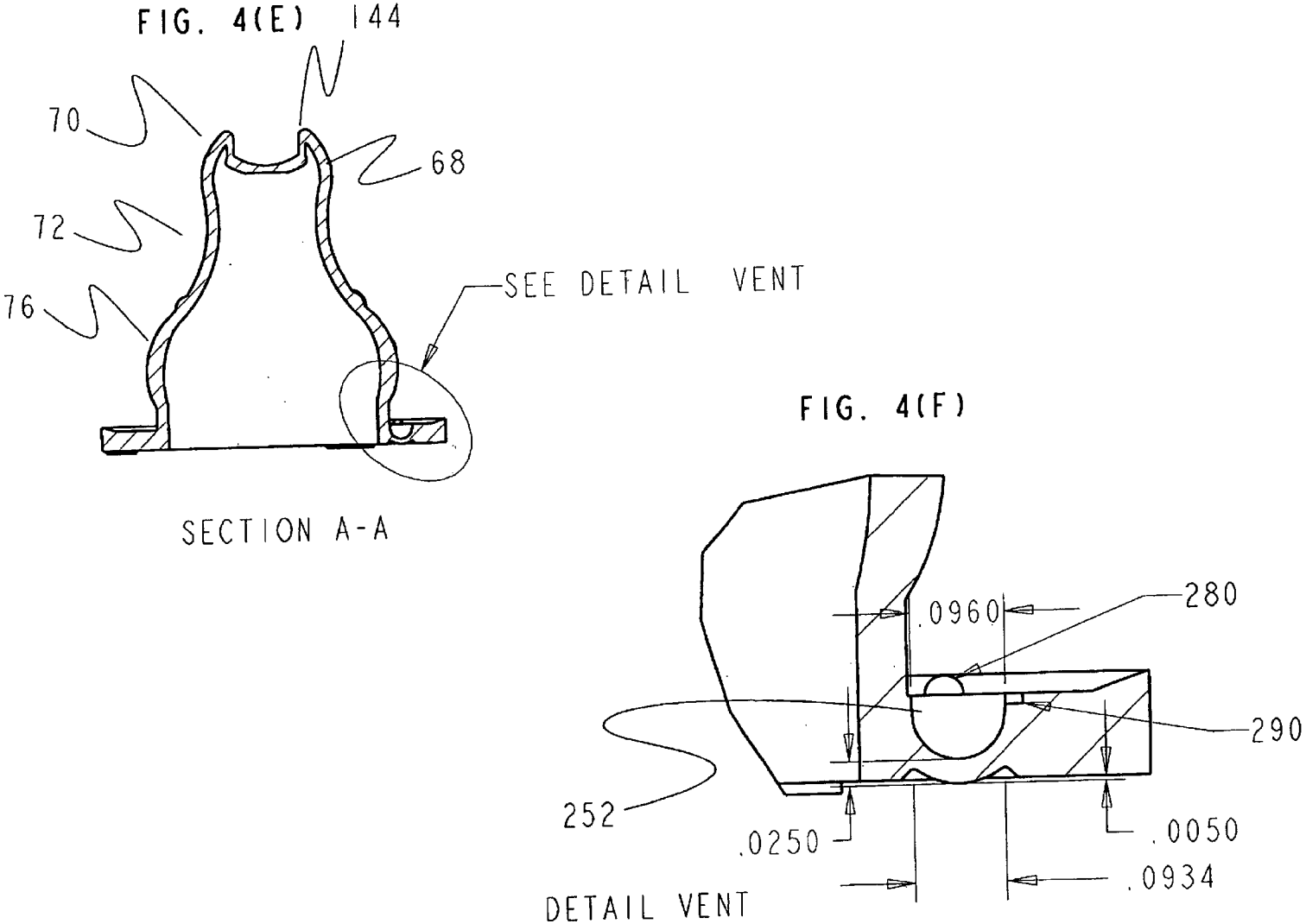

As an alternative to a spacer, a recessed area or channel 290 or 190 can be provided as shown for example in FIG. 4*f* and FIGS. 6*f* and 6*i*. Channel 290 is placed so that air can flow through the channel into the valve when the nipple is attached to the screw cap ring.

Figure 5E:
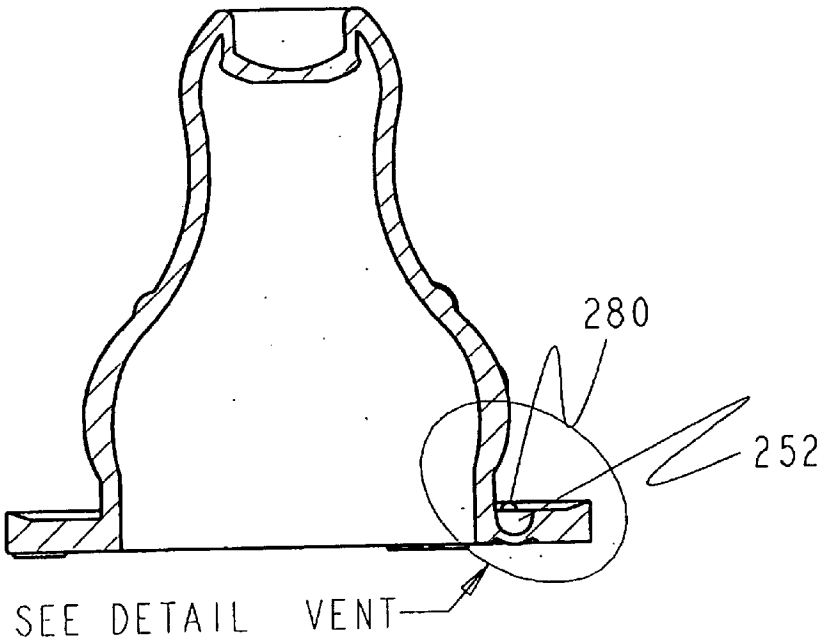

For example, this channel can surround or circle the valve 252, as shown in FIG. 4*f* to provide a channel area at the bottom rim of the nipple near where the nipple contacts the screw cap ring for air to pass into the air valve. If desired, a protrusion alone can be provided, as shown in FIG. 5*e*. Or both a protrusion and a channel can be provided as shown, for example, in FIG. 4*f*.

In the preferred embodiment, the channel extends from an bottom air valve on the bottom rim of the nipple up the side of the nipple. In other words, the channel extends from the air valve in the bottom rim into the outer surface of the outer wall of the nipple, preferably ending above the level of the screw cap ring.

Thus, as shown in FIGS. 6*i* and 6*f*, channel 190 extends from the bottom air valve 200 on the nipple's bottom rim 138 (which is under the screw cap) up the outer surface of the nipple wall, as a groove in that wall. The channel extends up to where the screw cap meets the outer wall of the nipple (the outer sidewall), channeling air from the outer wall of the nipple (outside the screw cap) under the screw cap to the air valve. Further preferably, the channel extends above the height of the screw cap. FIG. 6*f* illustrates the preferred dimensions of the embodiment of FIG. 6*i*.

Preferred dimensions for the air valve 200 of the nipple are shown in FIG. 6*f* (which corresponds to FIG. 6*i* with dimensioning provided thereto). As shown therein, the channel 190 along the outer surface of the nipple wall is preferably 0.0295 inches in depth before the base of the nipple widens, with the channel preferably being 0.1958 inches in height from the air valve up along the nipple wall. Once the base of the nipple begins to widen, the depth from the back surface of the channel in the nipple wall to the outermost tip of the channel is 0.0957 inches.

Air valve 200 has a bottom wall 210. In the preferred embodiment of the air valve of the nipple and drinking product with a spout, the bottom wall 210 is concave on both sides as shown, for example, in FIGS. 6*f* and 6*i*.

Bottom wall 210 is preferably 0.0200 inches in thickness at the very bottom portion of the wall. Increasing the bottom wall to too great a thickness at its bottom can make it difficult to open under the vacuum pressures that develop within the drinking vessel under normal use. Too thin a bottom wall, on the other hand, can potentially open under the weight of the liquid on the wall when the vessel is turned upside down or shaken. (In addition, too thin a bottom wall can be difficult to mold when the product is made of silicone, due to the fact that air traps and gassing can occur with a very thin wall during the molding process). The preferred thickness of 0.0200 inches at the bottom balances these competing consideration. As the wall ascends to meet the bottom rim of the nipple the wall increases in thickness to reach a preferred thickness of 0.0310. This thickening increases the strength of attachment of the bottom wall to the bottom rim, particularly when the air valve is exposed to the hydraulic pressure of liquid against it when the vessel is vigorously shaken.

As with the valve in the tip of the nipple, the bottom wall 210 of the air valve 200 has an opening therein. Any desired opening can be used; however, in the preferred embodiments of the air valve of the nipple and drinking product with soft spout, the opening in the air valve is a slit.

In the drinking product with a spout, preferably only one air valve is provided, the air valve being located in the soft lid portion of the cap, as shown in FIG. 8*b*. In the nipple product, preferably three air valves 200 are provided (also referred to herein as air valves or air vents), each air valve being at approximately 120 degrees of angular separation along the bottom rim 138, as shown in FIG. 6*c*.

In the preferred embodiment of the air valve of the nipple, the air valve has a preferred outer diameter of 0.1660 inches, a preferred inner diameter of 0.1100 inches and a preferred height (depth) of 0.0980 inches, as shown in FIG. 6*f*. The length of the slit is preferably half that height, i.e. 0.0490.

Some preferred dimensions for the air valve of the soft lid are shown in FIGS. 11–12. The depth of the depression of the air valve in the soft lid is 0.0895 inches (the depth from the bottom surface of the soft lid to the lower surface of the bottom wall of the depression, as shown in FIG. 11*d*), with the slit in that air valve being 0.1250 inches in length. The direction of the slit in the valve is toward the mouthpiece, i.e. the slit in the valve is parallel to the slits in the soft spout, as shown in FIG. 8*a*. Three air valves are preferably provided for the nipple, but only one for the soft lid.

In addition to the structure of the valve, to achieve optimal results it is preferred that the material should be neither be too flexible nor too rigid. Too much flexibility can allow the valve to invert or be pulled out of the nipple, or can allow the bottom wall to flex too much when liquid is shaken against it or so forth, allowing liquid through the opening. Too much rigidity can make it too difficult to drink from the nipple or spout. Thus, in the preferred embodiments, the nipples and soft lids are made of silicone.

Further preferably, the silicone used has a 45 durometer hardness (Shore A). Accordingly, the dimensions shown in the figures (e.g. FIGS. 6*e* and 6*f*, and so forth) have been optimized for use with that hardness silicone. (Other hardnesses can also be used, for example, 40–60 durometer hardness (Shore A)). Other materials or hardnesses could also be used consistent with the invention (e.g. latex or so forth). In that case, the dimensions of the product, and in particular the thicknesses of the components, would have to be adjusted accordingly.

Proper adjustment of the flexibility of the material, and the thickness of the individual components of the nipples and soft lids, in conjunction with the optimal structure for the valves will provide a no-spill product of maximal effectiveness.

Preferably, the nipple and soft lid (with soft spout) are made via conventional molding or dipping methods. For silicone, molding is preferably used, for example, injection molding or compression molding, or so forth. Liquid injection molding (LIMS) of silicone is preferred. If latex is used, the nipple or soft lid can be made using dipping.

Further preferably, the nipple is molded as one integral piece with the valve at top and the valve or valves at the bottom being part of that molded part. Likewise, the soft lid is also preferably molded as one piece with a valve at top and at bottom.

In additional embodiments of the invention, bumps 198 can be placed on the nipple as shown, for example, in FIGS. 5*a* and 5*b*, which are front and side views of a baby bottle nipple. Such bumps are described for example in the present inventor's prior U.S. Pat. No. 6,241,110, and U.S. patent application Ser. No. 10/108,229 filed Mar. 27, 2002 (U.S. Patent Application Publication No. 20030032984 A1 published Feb. 13, 2003), both of which are fully incorporated herein by reference. The bumps are preferably protrusions, although alternatively, they can be depressions in the soft material of the nipple.

Those nipples can be of a single hardness or can be of multiple hardnesses as described, for example, in the '110 patent. For the nipples of multiple hardnesses, the bumps are preferably harder than the soft material of the nipple and are particularly useful for the period when the baby is teething. The baby can, therefore, rub his or her gums on the harder material bump to ease discomfort during the teething process, and to assist the tooth in emerging through the gums.

For the nipple of a single hardness, the bumps are useful for placement on a nipple for use prior to the onset of the teething process. These bumps are the same hardness as the rest of the nipple and are used to accustom the baby to this type of nipple having bumps. Since a baby can become used to a particular type of nipple (and can reject other nipples which are different), use of this nipple of a single hardness is introduced prior to when the baby begins teething, so that, when teething begins, the baby can be switched to the multiple hardness nipple without concern about rejection of the nipple. Likewise, once teething ends, the baby can be switched back to a nipple of a single hardness having bumps thereon.

Moreover, in view of the construction of the present nipples, in accordance with the invention a baby can teethe on the bumps of the nipple without drinking or having liquid flow out of the bottle, if desired. This is due to the fact that compression of the base by itself will not open the valve. Rather, the tip of the nipple also needs to be compressed, with suction preferably applied thereto as well.

Likewise, the present invention can be used with any other configuration or type of baby bottle nipple desired, or with other drinking vessels. For example, as discussed above, instead of a nipple, a soft spout can be used on a drinking vessel with any combination of the features shown herein, including the depression at the top and/or bottom of the spout.

FIG. 8*e* is a top view of a no-spill cap 466 for a drinking product in accordance with the present invention. The no-spill cap is provided for attachment to a liquid holding container, the vessel being intended to be filled with a liquid for drinking. The volume of the cup or liquid holding portion of the assembly can be adjusted as desired. Thus, for example, a 7 oz. drinking cup, or 9 oz. drinking cup, or 6½ oz. cup, or any other size can be provided, as desired.

The sides of the cup can be provided with no handles, one handle, two handles or any other number of handles, for use to grip the cup. The handles and cup are preferably sized for the intended user. For example, in embodiments provided for children, the handle or handles are preferably sized for a child's hands. In addition, the outside appearance of the cup and/or the cap can be a solid color, or can be printed with any desired design.

In a further embodiment of the invention, the cup or bottle can be provided with a "grip", i.e. a gripping area for use to hold the cup more securely. This grip area can be in the form of a series of contours in the cup, as shown, for example, by grip 492 in FIGS. 10*b*, 10*c* and 11*b*. In an alternate or additional embodiment, the gripping area can be made of a soft material. Further preferably, a soft grip can be provided on a hard cup. For example, a soft ring can be provided around the outside of a hard cup, the ring being of any width desired, and serving as a finger grip, to make it easier to grasp the cup more securely. Preferably, the ring is approximately two inches (2") wide. If desired, the soft ring has shapes or designs cut out of it, such as stars, ovals, or so forth, whether for decorative purposes or to provide contour and ridging to improved the grip. If desired, the hard cup can be provided with raised areas or protuberances corresponding to those shapes or designs, with soft ring fitting snugly over these raised areas of the cup. Each of the protruding hard shapes then fit into the cutouts of the soft ring, with the surface of the raised areas and the soft ring being flush when the ring is inserted onto the cup.

Preferably, the cap is also provided with finger grips such as ridged surfaces 497 for gripping the cap. This assists in twisting the cap on and off of the cup or bottle, particularly if the user's hands are wet.

In one embodiment of the invention, the cup is constructed from polycarbonate. In an alternate embodiment, the cup is constructed from polypropylene. If desired, clear polypropylene can be utilized. Alternatively, any other suitable materials can be used for the components of the no-spill cup. The components of the cup are all made of durable materials, resistant to breakage, dishwasher safe, and preferably color fast.

In accordance with the invention, cap 466 is a cover for attachment to the drinking vessel such as a cup 491. The cap 466 includes a drinking spout 482 for drinking liquid from the cup. This spout may be hard or soft, but is preferably soft in the preferred embodiment. The spout is sized to allow an individual to place his or her mouth over the spout to drink therefrom. For example, in those embodiments designed for children, the spout is sized for a child of a young age, while in other embodiments, the spout may be sized for teenagers or adults.

Cap 466 may further include at least one hard component and at least one soft component therein. For example, in a preferred embodiment, the cap includes a hard screw ring 468 and a soft lid portion 480, with the drinking spout 482 preferably being part of the soft lid 480. Further preferably, the entire soft lid is formed as one integral component, e.g. a single molded piece.

The no-spill cap 466 forms a cover for placement onto the cup 491. When attached to the cup, a secure seal is formed such that no liquid can emerge through the connection between the cap and the cup. In use, the cap 466 is sufficiently secured to the cup such that shaking the cup assembly, dropping the cup on the floor, or other vigorous movement of the drinking product or application of sharp force thereto, is insufficient to separate the cap from the cup.

In one embodiment, the no-spill cap 466 and the drinking vessel include mating male and female screw threads, such that the cap 466 is a screw-on cap which can be easily rotated onto the cup, as is known in the art. In an alternative embodiment, a snap-on cap can be used. In this embodiment, for example, a resilient ring portion of the cap can be provided to securely fit over the lip of a cup, as is also well known in the art. Although a screw-on cap or a snap-on cap are shown as two preferred embodiments, alternatively, any other suitable mechanism to secure the cap to the tumbler cup can be utilized.

Either the screw-on cap and/or the snap-on cap can be further provided with a gasket between the tumbler cup and the cap, to further seal the connection between the cup and the cap. This gasket can be part of the cup or the cap, or can be a separate element inserted between the cap and the cup. If a gasket is utilized, the gasket is preferably part of the cap 8. Alternatively, the cap can be provided with a small annular inner lip, on the inside of the cap, which acts as a gasket. This lip wedges inside the cup when the cap is screwed or placed upon it. The lip acts to further prevent the possibility of liquid flow through the contact between the cup and the cap.

In a preferred embodiment, finger grips 497 are provided on the outside of the cap, such as grooves or ridges or so forth. These grips facilitate removal and application of the cap, particularly in those embodiments requiring the screwing of the cap on and off of the cup.

The cap is also preferably interchangeable with numerous tumbler cups of different sizes. In this embodiment, the necks of the cups are all of the same diameter, although the cups themselves are of different volumes. For example, the same sized cap could be used on a 6½ oz. cup and/or a 7 oz. cup and/or a 9 oz. cup, and so forth.

In the preferred embodiment, the spout of the cap is a soft spout as described above. Preferably, the spout is made of a thermoelastomer, although any other suitable soft material can be used consistent with the present invention.

Preferably, the soft lid is removably attached to the ring, as discussed above. For example, the bottom of the soft lid can be provided with a recess 478 such that the lid can it can be easily snapped in and out of the ring, as desired. The soft lid is, for example, inserted through the bottom of the hard ring until the lip of the ring snugly fits in the groove. The lid of the drinking cup can therefore be assembled as with the insertion of a baby bottle nipple into a hard ring, in the baby bottles known in the art. In the embodiment with the spout however, at least two notches 494 are preferably provided in the soft lid. These notches fit onto a small extension (such as a small post or small button) on the top of the screw ring so as to orient the soft lid in the proper direction. FIG. 10*b* for example, shows the orientation of the spout with respect to the grip 492. Properly orienting the spout with respect to the grip helps ensure that when the user holds the drinking vessel, the spout is inserted into his or her mouth in the correct orientation, with the slits in the bottom wall of the valve being vertical.

In an alternate embodiment, the soft spout can be molded to the cap. In either embodiment, the inside of the spout is smooth and unobstructed such that any liquid flowing into the spout when the drinking vessel is turned upside down (e.g. when the user is not drinking), returns easily into the drinking vessel when the vessel is turned right side up. Furthermore, although it is preferred that the soft spout be part of a soft lid, in an alternate embodiment, the entire cap can be hard with the exception of a soft spout attached thereto. Or, in a less preferred embodiment, a hard spout can be provided with the valve located therein.

When a person takes a drinking product having the valve of the present invention to begin to drink therefrom, he or she will place his or her mouth on the outer surface 112 of nipple outer wall 110. When the nipple or spout has a wider diameter portion (or outer wall bulge) near the tip such as bulge 68, that bulge will naturally slide behind the teeth of the user.

In the case of the nipple, the teeth themselves will normally slide below the nipple's tip (and below the bulge) to rest on the neck of the nipple. Generally, the teeth will slide down the neck of the nipple to rest at the intersection of the nipple's neck and the nipple base, where the base of the nipple begins. In other words the teeth will normally slide down to the top of the base, where the nipple begins to widen. However, the teeth may also be held higher on the nipple, whether unintentionally or by choice.

In the case of the spout, the teeth will slide below the tip of the spout (and below the bulge if one is provided), to rest on the neck, usually near or at the location where the neck of the spout meets the base of the lid. Alternatively, the teeth may be held higher on the spout.

To drink from the product, the user naturally bites down on the nipple or spout's outer wall. The lips and teeth and tongue of the user cooperate in compressing the nipple or spout outer wall, with the upper lips, upper teeth and upper roof of the mouth squeezing downwards on the nipple, while the lower lips, lower teeth and tongue squeezing upwards.

When biting, the mouth compresses the inner surface 114 of the outer wall 110 of the nipple across the space 116 and toward the outer surface 124 of the sidewall of the valve, with compression of the tip of the nipple. (Although the present discussion of use refers to some degree to the structure of the nipple, it will be understood that principles described herein also apply to operation of the spout).

In the preferred embodiment, the valve is positioned high up in the nipple or spout as discussed above. As the mouth compresses the tip of the valve, the inner surface 114 of the outer wall 110 contacts protrusion 130 of the sidewall. Protrusion 130 acts as a lever or fulcrum (or like a "cue ball" in the game of pool), efficiently transmitting force to the bottom wall of the valve, and compressing the bottom wall of the valve. The compression and folding of the bottom wall 140 in turn opens the opening 137, so that liquid can flow through the valve.

Further in the preferred embodiment, when the user compresses the nipple or spout (to open the opening in the bottom wall), he or she will also begin to suck liquid through the opening. This sucking creates negative pressure within the nipple or below the soft lid. This in turn will pull open the opening of the bottom valve, allowing air flow to flow into the drinking vessel. Once air begins to flow into the vessel, liquid can flow freely through the opening.

In the preferred embodiments, the nipple (or spout) is designed with a high valve to avoid flow of liquid through the opening when not being compressed in the user's mouth. Thus, if a user applies compression at or near the base portion of the nipple (by squeezing it with the hands for example), or along the neck, the compressive force is not transmitted to the protrusion 130, and the opening 137 will not open for liquid flow. This further enhances the no-spill characteristics of the nipple.

Further, the upper tubular portion of the valve also serves as a "shock absorber", absorbing force exerted during shaking of the drinking vessel, via the upward and downward vibration of that tube. Furthermore the space between the sidewall of the valve and the wall of the nipple or spout provides an open area for liquid to flow into. In addition, since the valve is preferably symmetrical, the hydraulic pressures exerted on the sidewalls and bottom wall are believed to counteract each other, preventing the shaking of liquid from opening the valve. The particular shape of the bottom wall and sidewalls and so forth further contribute to the highly effective functioning of the valve.

As a result, as described herein, drinking products are provided which are very effectively non-spill, while still very comfortable to drink from. The present inventions appropriately balance effective no-spill properties with comfortable flow of liquid, providing the optimal balance of sealing and opening for a maximally effective no-spill product. The inventions are designed to allow one to drink liquid from the device under the normal forces and pressures exerted by the mouth of the user, in a comfortable fashion.

Having described this invention with regard to specific embodiments, it is to be understood that the description is not meant as a limitation since further modifications may suggest themselves, or may be apparent to those in the art. It is intended that the present application cover all such modifications and improvements thereon.

What is claimed is:

1. A method, comprising:

providing a drinking apparatus, said drinking apparatus being a no-spill drinking apparatus provided for a user to drink liquid therefrom and also being provided for preventing spilling of liquid when the user is not drinking from said apparatus;

said drinking apparatus comprising a flexible material outer wall for the user to place its mouth on to drink liquid from said drinking apparatus, said flexible material outer wall comprising a tip, said outer wall further comprising an outer surface and an inner surface;

said drinking apparatus further comprising a valve for preventing the spilling of liquid from said apparatus when the user is not drinking from said apparatus, said valve comprising a depression in said flexible material outer wall, said depression comprising an upper component and a lower component, said upper component comprising a tube, said tube comprising a sidewall, said sidewall comprising an outer surface and an inner surface, said outer surface of said sidewall being separated and spaced from said inner surface of said outer wall;

said lower component of said valve comprising a bottom wall, said bottom wall comprising an upper surface and a lower surface, said upper surface of said bottom wall being a concave surface extending to said inner surface of said sidewall;

said lower surface of said bottom wall comprising both a curved surface and a flat surface, wherein said flat surface is located in the center of said lower surface, and wherein said curved surface is peripheral to said flat surface;

said bottom wall comprising an opening extending from said upper surface to said lower surface, and wherein said opening rests in a closed position;

and wherein said bottom wall bends when the user places its mouth on said outer wall to compress said outer wall, such that liquid can pass through said opening.

2. A method as claimed in claim 1, further comprising the step of providing said apparatus for use by a baby, wherein said apparatus comprises a baby bottle nipple.

3. A method as claimed in claim 1, further comprising the step of providing said apparatus for use by a baby, wherein said apparatus comprises a baby bottle nipple and a baby bottle.

4. A method as claimed in claim 1, wherein said apparatus comprises a product with a soft drinking spout.

5. A method as claimed in claim 1, wherein said apparatus comprises a liquid holding container.

6. A method as claimed in claim 1, wherein said apparatus comprises a cap, said cap comprising a soft drinking spout.

7. A method as claimed in claim 1, wherein said apparatus comprises a cap for attachment to a liquid holding container, said cap comprising a soft lid for attachment to a hard screw-ring, said soft lid further comprising a soft drinking spout.

8. A method as claimed in claim 1, wherein said depression is made of said flexible material.

9. A method as claimed in claim 1, wherein said valve is located in said tip.

10. A method as claimed in claim 1, wherein said tip comprises a widened portion, and wherein said bottom wall is located near said widened portion of said tip.

11. A method as claimed in claim 1, wherein said apparatus further comprises a bottom valve.

12. A method as claimed in claim 1, wherein said apparatus further comprises a bottom valve, said bottom valve comprising a dome shaped depression in said flexible material, said dome shaped depression further comprising an opening, said opening comprising a slit.

13. A method as claimed in claim 1, wherein liquid does not emerge from said drinking apparatus upon shaking of said apparatus, unless said outer wall is compressed.

14. A method as claimed in claim 1, wherein said apparatus includes a hard cup.

15. A method, comprising:

providing a drinking apparatus, said drinking apparatus being a no-spill drinking apparatus provided for a user to drink liquid therefrom and also being provided for preventing spilling of liquid when the user is not drinking from said apparatus;

said drinking apparatus comprising a flexible material outer wall for the user to place its mouth on to drink liquid from said drinking apparatus, said outer wall further comprising an outer surface and an inner surface;

said drinking apparatus further comprising an valve for preventing the spilling of liquid from said apparatus when the user is not drinking from said apparatus, said valve comprising a depression in said flexible material outer wall, said depression comprising an upper component and a lower component, said upper component comprising a tube, said tube comprising a sidewall, said sidewall comprising an outer surface and an inner surface, said outer surface of said sidewall being separated and spaced from said inner surface of said outer wall;

said outer surface of said sidewall comprising a protrusion thereon, said protrusion extending from said outer surface of said sidewall toward said inner surface of said outer wall;

said valve comprising a bottom wall, said bottom wall comprising an upper surface and a lower surface, said bottom wall comprising an opening extending from said upper surface to said lower surface, wherein said opening rests in a closed position;

and wherein said inner surface of said outer wall contacts said protrusion when the user places its mouth on said outer wall to compress said outer wall, causing said bottom wall to bend such that liquid can pass through said opening.

16. A method as claimed in claim 15, further comprising the step of providing said apparatus for use by a baby, wherein said apparatus comprises a baby bottle nipple.

17. A method as claimed in claim 15, further comprising the step of providing said apparatus for use by a baby, wherein said apparatus comprises a baby bottle nipple and a baby bottle.

18. A method as claimed in claim 15, wherein said apparatus comprises a product with a soft drinking spout.

19. A method as claimed in claim 15, wherein said apparatus comprises a liquid holding container.

20. A method as claimed in claim 15, wherein said apparatus comprises a cap, said cap comprising a soft drinking spout.

21. A method as claimed in claim 15, wherein said apparatus comprises a cap for attachment to a liquid holding container, said cap comprising a soft lid for attachment to a hard screw-ring, said soft lid further comprising a soft drinking spout.

22. A method as claimed in claim 15, wherein said depression is made of said flexible material.

23. A method as claimed in claim 15, wherein said outer wall comprises a tip, and wherein said valve is located in said tip.

24. A method as claimed in claim 15, wherein said outer wall comprises a tip, and wherein said tip comprises a widened portion, and wherein said bottom wall is located near said widened portion of said tip.

25. A method as claimed in claim 15, wherein said apparatus further comprises a bottom valve.

26. A method as claimed in claim 15, wherein said apparatus further comprises a bottom valve, said bottom valve comprising a dome shaped depression in said flexible material, said dome shaped depression further comprising an opening, said opening comprising a slit.

27. A method as claimed in claim 15, wherein liquid does not emerge from said drinking apparatus upon shaking of said apparatus, unless said outer wall is compressed.

28. A method as claimed in claim 15, wherein said apparatus includes a hard cup.

29. A method, comprising:

providing a drinking apparatus, said drinking apparatus being a no-spill drinking apparatus provided for a user to drink liquid therefrom and also being provided for preventing spilling of liquid when the user is not drinking from said apparatus;

said drinking apparatus comprising a flexible material outer wall for the user to place its mouth on to drink liquid from said drinking apparatus, said outer wall further comprising an outer surface and an inner surface;

said drinking apparatus further comprising a valve for preventing the spilling of liquid from said apparatus when the user is not drinking from said apparatus, said valve comprising a depression in said flexible material outer wall, said depression comprising an upper component and a lower component, said upper component comprising a tube, said tube comprising a sidewall, said sidewall comprising an outer surface and an inner surface, said outer surface of said sidewall being separated and spaced from said inner surface of said outer wall;

said outer surface of said sidewall comprising a protrusion thereon, said protrusion extending towards said inner surface of said outer wall;

said lower component of said valve comprising a bottom wall, said bottom wall comprising an upper surface and a lower surface, said upper surface of said bottom wall being a concave surface extending to said inner surface of said sidewall;

said lower surface of said bottom wall comprises both a curved surface and a flat surface, wherein said flat surface is located in the center of said lower surface, and wherein said curved surface is peripheral to said flat surface;

said bottom wall comprising an opening extending from said upper surface to said lower surface, wherein said opening rests in a closed position;

and wherein said inner surface of said outer wall contacts said protrusion when the user places its mouth on said outer wall to compress said outer wall, causing said bottom wall to bend such that liquid can pass through said opening.

30. A method as claimed in claim 29, further comprising the step of providing said apparatus for use by a baby, wherein said apparatus comprises a baby bottle nipple.

31. A method as claimed in claim 29, further comprising the step of providing said apparatus for use by a baby, wherein said apparatus comprises a baby bottle nipple and a baby bottle.

32. A method as claimed in claim 29, wherein said apparatus comprises a product with a soft drinking spout.

33. A method as claimed in claim 29, wherein said apparatus comprises a liquid holding container.

34. A method as claimed in claim 29, wherein said apparatus comprises a cap, said cap comprising a soft drinking spout.

35. A method as claimed in claim 29, wherein said apparatus comprises a cap for attachment to a liquid holding container, said cap comprising a soft lid for attachment to a hard screw-ring, said soft lid further comprising a soft drinking spout.

36. A method as claimed in claim 29, wherein said depression is made of said flexible material.

37. A method as claimed in claim 29, wherein said outer wall comprises a tip, and wherein said valve is located in said tip.

38. A method as claimed in claim 29, wherein said outer wall comprises a tip, and wherein said tip comprises a widened portion, and wherein said bottom wall is located near said widened portion of said tip.

39. A method as claimed in claim 29, wherein said apparatus further comprises a bottom valve.

40. A method as claimed in claim 29, wherein said apparatus further comprises a bottom valve, said bottom valve comprising a dome shaped depression in said flexible material, said dome shaped depression further comprising an opening, said opening comprising a slit.

41. A method as claimed in claim 29, wherein liquid does not emerge from said drinking apparatus upon shaking of said apparatus, unless said outer wall is compressed.

42. A method as claimed in claim 29, wherein said apparatus includes a hard cup.

43. A method, comprising:

providing a drinking apparatus, said drinking apparatus being a no-spill drinking apparatus provided for a user to drink liquid therefrom and also being provided for preventing spilling of liquid when the user is not drinking from said apparatus;

said drinking apparatus comprising a flexible material outer wall for the user to place its mouth on to drink liquid from said drinking apparatus, said outer wall further comprising an outer surface and an inner surface;

said drinking apparatus further comprising a valve for preventing the spilling of liquid from said apparatus when the user is not drinking from said apparatus, said valve comprising a depression in said flexible material outer wall, said depression comprising an upper component and a lower component, said upper component comprising a tube, said tube comprising a sidewall, said sidewall comprising an outer surface and an inner surface, said outer surface of said sidewall being separated and spaced from said inner surface of said outer wall;

said lower component of said valve comprising a bottom wall, said bottom wall comprising an upper surface and a lower surface, said upper surface of said bottom wall being a concave surface extending to said inner surface of said sidewall;

said lower surface of said bottom wall approximating the shape of the top of a trapezoid, said lower surface comprising both a outer surface and a flat surface, wherein said flat surface is located in the center of said lower surface, and wherein said outer surface is peripheral to said flat surface;

said bottom wall comprising an opening extending from said upper surface to said lower surface, and wherein said opening rests in a closed position;

and wherein said bottom wall bends when the user places its mouth on said outer wall to compress said outer wall, such that liquid can pass through said opening.

44. A method as claimed in claim 43, wherein said apparatus includes a hard cup.

45. A method as claimed in claim 44, wherein said outer surface of said lower surface of said bottom wall is straight.

46. A method as claimed in claim 44, wherein said outer surface of said lower surface of said bottom wall is curved.

* * * * *